US009206710B2

(12) United States Patent
Gurin

(10) Patent No.: US 9,206,710 B2
(45) Date of Patent: Dec. 8, 2015

(54) COMBINED CYCLE HYBRID VEHICLE POWER GENERATION SYSTEM

(71) Applicant: Michael H Gurin, Glenview, IL (US)

(72) Inventor: Michael H Gurin, Glenview, IL (US)

( * ) Notice: Subject to any disclaimer, the term of this patent is extended or adjusted under 35 U.S.C. 154(b) by 118 days.

(21) Appl. No.: 14/050,073

(22) Filed: Oct. 9, 2013

(65) Prior Publication Data

US 2015/0096300 A1 Apr. 9, 2015

(51) Int. Cl.

| | |
|---|---|
| ***F02C 6/08*** | (2006.01) |
| ***F02C 3/04*** | (2006.01) |
| ***F01K 23/10*** | (2006.01) |
| ***F01K 23/04*** | (2006.01) |
| ***F01K 23/08*** | (2006.01) |
| ***F01K 15/02*** | (2006.01) |

(52) U.S. Cl.

CPC ..... *F01K 23/10* (2013.01); *F01K 15/02* (2013.01); *F01K 23/04* (2013.01); *F01K 23/08* (2013.01)

(58) Field of Classification Search

CPC ..... F01K 23/10; F01K 23/08; F01K 23/04
USPC ..... 60/39.182, 655
See application file for complete search history.

(56) References Cited

U.S. PATENT DOCUMENTS

| | | | | |
|---|---|---|---|---|
| 2,427,845 | A * | 9/1947 | Forsyth | 60/243 |
| 4,896,499 | A * | 1/1990 | Rice | 60/792 |
| 5,791,136 | A * | 8/1998 | Utamura et al. | 60/39.182 |
| 6,230,480 | B1 * | 5/2001 | Rollins, III | 60/39.182 |
| 8,596,066 | B2 * | 12/2013 | Zimron et al. | 60/641.2 |
| 2008/0121755 | A1 * | 5/2008 | Bennett | 244/59 |
| 2010/0107651 | A1 * | 5/2010 | Hyde et al. | 60/784 |

* cited by examiner

*Primary Examiner* — Hoang Nguyen

(57) ABSTRACT

An integral combined cycle electric power generation system capable of generating electricity in any environment in which a fluid, such as air, moves relative to the system. Preferably this system is integrated with a hybrid airplane, though it is applicable in a number of other scenarios including, but not limited to, integration with: locomotives, ships, automobiles, trucks, and wind turbines. An exterior surface of the machine in which the system is thermally integrated is a condenser in a closed loop Rankine or Brayton cycle.

17 Claims, 19 Drawing Sheets

ICAO STANDARD ATMOSPHERE

| ALTITUDE FT. | DENSITY RATIO $\sigma$ | $\sqrt{\sigma}$ | PRESSURE RATIO $\delta$ | TEMPER-ATURE °F | TEMPER-ATURE RATIO $\theta$ | SPEED OF SOUND $a$ KNOTS | KINEMATIC VISCOSITY $\nu$ FT²/SEC |
|---|---|---|---|---|---|---|---|
| 0 | 1.0000 | 1.0000 | 1.0000 | 59.00 | 1.0000 | 661.7 | .000158 |
| 1000 | 0.9711 | 0.9854 | 0.9644 | 55.43 | 0.9931 | 659.5 | .000161 |
| 2000 | 0.9428 | 0.9710 | 0.9298 | 51.87 | 0.9862 | 657.2 | .000165 |
| 3000 | 0.9151 | 0.9566 | 0.8962 | 48.30 | 0.9794 | 654.9 | .000169 |
| 4000 | 0.8881 | 0.9424 | 0.8637 | 44.74 | 0.9725 | 652.6 | .000174 |
| 5000 | 0.8617 | 0.9283 | 0.8320 | 41.17 | 0.9656 | 650.3 | .000178 |
| 6000 | 0.8359 | 0.9143 | 0.8014 | 37.60 | 0.9587 | 647.9 | .000182 |
| 7000 | 0.8106 | 0.9004 | 0.7716 | 34.04 | 0.9519 | 645.6 | .000187 |
| 8000 | 0.7860 | 0.8866 | 0.7428 | 30.47 | 0.9450 | 643.3 | .000192 |
| 9000 | 0.7620 | 0.8729 | 0.7148 | 26.90 | 0.9381 | 640.9 | .000197 |
| 10000 | 0.7385 | 0.8593 | 0.6877 | 23.34 | 0.9312 | 638.6 | .000202 |
| 15000 | 0.6292 | 0.7932 | 0.5643 | 5.51 | 0.8969 | 626.7 | .000229 |
| 20000 | 0.5328 | 0.7299 | 0.4595 | −12.32 | 0.8625 | 614.6 | .000262 |
| 25000 | 0.4481 | 0.6694 | 0.3711 | −30.15 | 0.8281 | 602.2 | .000302 |
| 30000 | 0.3741 | 0.6117 | 0.2970 | −47.98 | 0.7937 | 589.5 | .000349 |
| 35000 | 0.3099 | 0.5567 | 0.2353 | −65.82 | 0.7594 | 576.6 | .000405 |
| *36089 | 0.2971 | 0.5450 | 0.2234 | −69.70 | 0.7519 | 573.8 | .000419 |
| 40000 | 0.2462 | 0.4962 | 0.1851 | −69.70 | 0.7519 | 573.8 | .000506 |
| 45000 | 0.1936 | 0.4400 | 0.1455 | −69.70 | 0.7519 | 573.8 | .000643 |
| 50000 | 0.1522 | 0.3902 | 0.1145 | −69.70 | 0.7519 | 573.8 | .000818 |
| 55000 | 0.1197 | 0.3460 | 0.0900 | −69.70 | 0.7519 | 573.8 | .001040 |
| 60000 | 0.0941 | 0.3068 | 0.0708 | −69.70 | 0.7519 | 573.8 | .001323 |
| 65000 | 0.0740 | 0.2721 | 0.0557 | −69.70 | 0.7519 | 573.8 | .001682 |
| 70000 | 0.0582 | 0.2413 | 0.0438 | −69.70 | 0.7519 | 573.8 | .002139 |
| 75000 | 0.0458 | 0.2140 | 0.0344 | −69.70 | 0.7519 | 573.8 | .002721 |
| 80000 | 0.0360 | 0.1897 | 0.0271 | −69.70 | 0.7519 | 573.8 | .003460 |
| 85000 | 0.0280 | 0.1673 | 0.0213 | −64.80 | 0.7613 | 577.4 | .004499 |
| 90000 | 0.0217 | 0.1472 | 0.0168 | −56.57 | 0.7772 | 583.4 | .00591 |
| 95000 | 0.0169 | 0.1299 | 0.0134 | −48.34 | 0.7931 | 589.3 | .00772 |

Fig. 19

COMBINED CYCLE HYBRID VEHICLE POWER GENERATION SYSTEM

FIELD OF THE INVENTION

The present invention relates to generation of electricity under conditions where a fluid moves relative to a combined cycle power generation system and more particularly to methods and apparatus for integrating such a system with hybrid vehicles, such as airplanes, or other machines such that a surface of the hybrid vehicle functions as a component of the power generation bottom cycle.

CROSS-REFERENCE TO RELATED APPLICATIONS

This application does not claim any priority over prior patent applications.

BACKGROUND OF THE INVENTION

As energy, fuel, and transportation costs continue to rise along with concerns about greenhouse gas emissions, it is desirable to integrate power generation systems into the devices for which the electricity is generated. Hybrid automobiles, for instance, generate electricity through regenerative braking, which converts the kinetic energy of the vehicle to electricity as it slows. This electricity is then used to power the car, reducing its fuel consumption and increasing its energy efficiency, thus lowering travel costs. Conceptually similar systems are viable for other forms of transportation and even for standalone power production and would allow for reduced oil consumption and carbon dioxide emission.

Combined cycles have already been used in electric power generation to optimize efficiency. In a combined cycle, the exhaust from a first thermodynamic cycle, referred to as the "top cycle", is used as the heat source for a second cycle, called the "bottom cycle". This allows more useful work to be extracted from a fixed quantity of fuel, increasing efficiency. In a non-combined cycle, the exhaust heat is usually wasted. The increased fuel efficiency of the combined cycle lowers the costs of both fuel and energy—all while reducing emissions.

The integration of a combined cycle into a hybrid vehicle could thus greatly enhance the energy efficiency of such vehicles and reduce petroleum-based fuel consumption. The implementation of a combined cycle to create hybrid airplanes is especially significant, as the ambient temperature in which it cruises is significantly cold, creating a high delta Temperature. Though an enormous increase in air travel is predicted over the next few decades, such a system would help to partially negate its environmental impact.

Thus, the need exists for a system to increase fuel efficiency applicable in a wide variety of situations, providing both environmental and economic advantages.

SUMMARY OF THE INVENTION

It is therefore an object of the present invention to provide a system of power generation, preferably direct to electricity (though also anticipated to be direct to mechanical connection) that uses a combined cycle which is fully integrated with a transportation vehicle and/or a stationary wind turbine having a moving turbine blade where wind motion relative to the blade is utilized by the system.

The present invention can be implemented in any device in which a fluid, such as air, moves relative to the power generation system. These devices can include, but are not limited to: airplanes, locomotives, ships, automobiles, trucks, and wind turbines. The case of integration with an airplane is of particular interest, and so the language and figures herein refer specifically to this case, though the present invention is intended to cover in the appended claims all such modifications and equivalents, including use in other situations.

Preferably, the condenser of the bottom cycle is an exterior surface of the device with which the power generation system is integrated. In the case of the hybrid airplane, the fuselage exterior would preferably function as the condenser. In the particularly preferred embodiment, the wings, ailerons, and horizontal stabilizers function as the condenser, and in the specifically preferred embodiment, the upper surfaces of these components are the bottom cycle condenser. The latter has the intended effect of transferring heat from the bottom cycle to the air above the wings and stabilizers, generating extra lift. Thus, the present invention advantageously decreases airplane fuel consumption by first utilizing the bottom cycle to generate both additional power and secondly from the additional lift that is otherwise not present without the vehicle movement.

Because the amount of heat radiated by the condenser is not directly controllable in this electric power generation system (i.e., the condenser is void of fans as too much drag would be created, which without being bound by theory would at least partially offset any efficiency gains from the thermodynamic cycle), controllers calculate heat dissipation capacity in advance using measurable and predictable atmospheric values. For example, ambient temperature at a given altitude can be predicted, in the case of the hybrid airplane, using readily available atmospheric data. This, along with the bottom cycle working fluid mass flow rate and several other variables, allows the heat loss capacity to be calculated and the combined cycle to be adjusted accordingly such that bottom cycle pump cavitation does not occur if a Rankine cycle is utilized.

The bottom cycle is preferred to be a Rankine cycle, in which the working fluid transitions between liquid and vapor phases. Such a cycle requires that the working fluid transition to a liquid before reaching the bottom cycle pump. However, if a Brayton cycle is utilized, the working fluid remains in a vapor phase, so a phase transition prior to the pump is unnecessary.

The scenario in which the combined cycle power generation system is integrated with a wind turbine is also of particular interest, though it is only minimally described elsewhere in the patent application. In this arrangement, the top cycle may be housed in the rotor hub, nacelle, or elsewhere; the same applies for the bottom cycle. The spinning turbine blades function as the bottom cycle condenser, much like the wings do when the power generation system is thermally integrated with an airplane's active surface. Thus, the turbine contains three power generation systems: the top cycle, the bottom cycle, and the wind turbine itself.

This summary of the invention and the objects, advantages, and features thereof have been presented here simply to point out some of the ways that the invention overcomes difficulties presented in the prior art and to distinguish the invention from the prior art and is not intended to operate in any manner as a limitation on the interpretation of claims that are presented initially in the patent application and that are ultimately granted.

BRIEF DESCRIPTION OF THE DRAWINGS

These and other objects, advantages, and features of the present invention will be more readily understood from the following detailed description of the preferred embodiments thereof, when considered in conjunction with the drawings, in which like reference numerals indicate identical structures throughout the several views, and wherein:

FIG. 19 is a standard altitude table.

DETAILED DESCRIPTION OF THE PREFERRED EMBODIMENTS OF THE INVENTION

The terms "condenser(s)" and "wings", as used herein, are interchangeable, as the bottom cycle condenser is the airplane fuselage in the preferred embodiment; the wings, ailerons, and horizontal stabilizers in the particularly preferred embodiment; and the upper surfaces of the wings, ailerons, and horizontal stabilizers in the specifically preferred embodiment.

The terms "exhaust" and "waste heat", as used herein, are interchangeable, as exhaust gases contain the waste heat.

The term "float", as used herein, means to allow a value, i.e., temperature or pressure, to fluctuate in accordance with changing atmospheric conditions.

All decisions in which a temperature is compared to its maximum or optimum value is considered equal preferably if it is within 2% of the target value. It is particularly preferred the temperature come within 1.5% of the target, and specifically preferred it approaches within 1% of the target.

Figure 1:
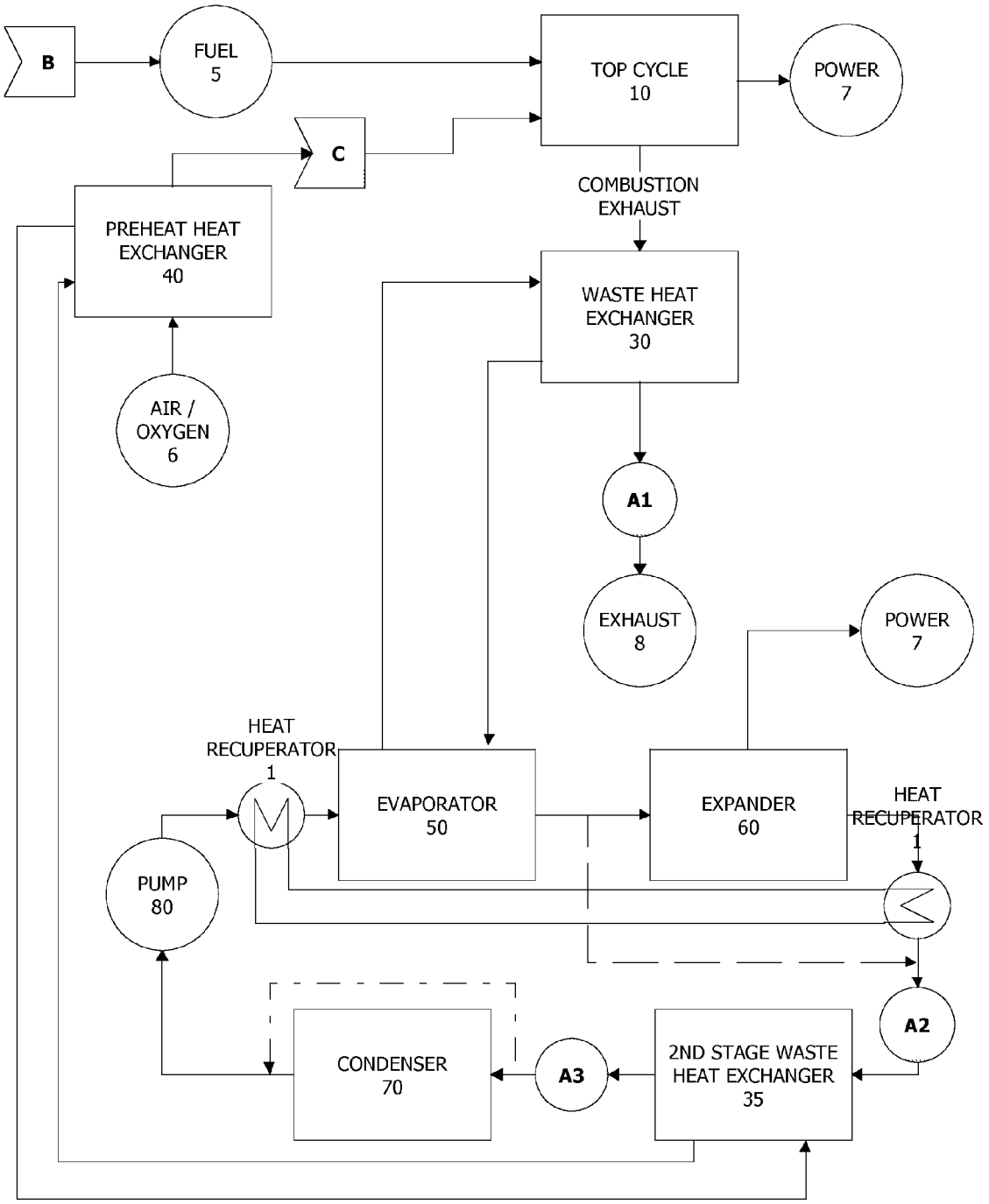
FIG. 1 is a schematic of the Hybrid Airplane Combined Cycle Power Generation System in accordance with the present invention.

FIG. 1 is a schematic illustrating the Hybrid Airplane Combined Cycle Power Generation System. The Connection Points A (A1, A2, and A3) are connection points between the combined cycle and the fuel 5 preheater system. These points can function as heat inlets and/or heat outlets such that heat entering the preheater system at a Point A can reenter the combined cycle at the same Point A or a Point A with a greater index number. Points B and C are the entry points of preheated fuel 5 and oxidant 6 (i.e., air or oxygen), respectively, into the top cycle 10.

Figure 2:
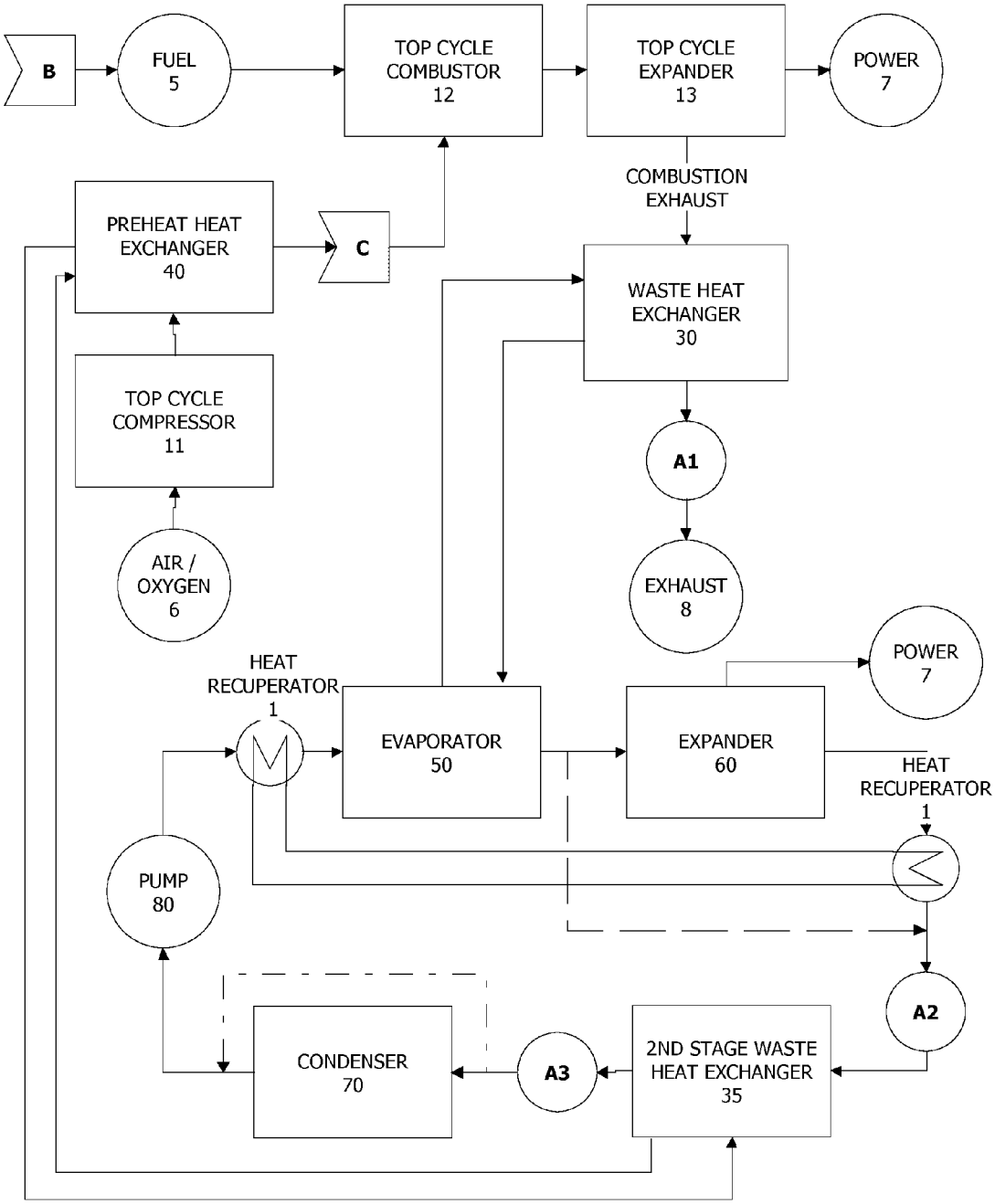
FIG. 2 is another schematic of the Hybrid Airplane Combined Cycle Power Generation System in accordance with the present invention.

Fuel 5 and oxidant 6 (which may be either stored or obtained from the atmosphere) enter the top cycle 10 after possible preheating. Power 7 is extracted from the top cycle 10 either for immediate use or for transfer to energy storage 9, and the combustion exhaust is channeled into a waste heat exchanger 30. The waste heat exchanger 30 can then transmit the heat via point A1 to the fuel 5 preheater system before exhausting the combustion products into the atmosphere 8, and/or it can transmit heat to the bottom cycle evaporator 50, where it will be used to evaporate the working fluid of the bottom cycle. In practice, heat will primarily be transmitted to the bottom cycle evaporator 50, and any remaining heat will be used to preheat fuel 5 and oxidant 6. It is understood that heat can be exhausted to the bottom cycle from anywhere after the top cycle expander 13, one component of the top cycle 10, which is depicted in FIG. 2. Heat from the bottom cycle evaporator 50 can also be transferred back to the top cycle waste heat exchanger 30 to preheat fuel 5 and oxidant 6.

The bottom cycle consists of an evaporator 50, an expander 60, a set of heat exchangers for waste heat recuperation 1, a second stage waste heat exchanger 35, a condenser 70 (i.e., the wings), and a working fluid pump 80. It is itself a simple thermodynamic cycle as known in the art. Points A2 and A3 are other possible connection points of the fuel 5 preheater system. The second stage waste heat exchanger 35 can transfer heat to the top cycle preheat heat exchanger 40, where the energy is used to preheat oxidant 6; it can also receive heat from the top cycle preheat heat exchanger 40 in order to preheat fuel 5 and/or oxidant 6, heat the de-icing system, or heat energy storage 9. The different kinds of dashed lines indicate heat routes used when certain bottom cycle components are bypassed: If the expander 60 and recuperator 1 are bypassed, the dashed line is followed, and if the condenser 70 is bypassed, the alternating dashed-dotted line is followed.

FIG. 2 is another schematic illustrating the combined cycle hybrid airplane power system. This figure elaborates on the various components of the top cycle 10, which consists of a compressor 11, a combustor 12, and an expander 13. The top cycle compressor 11 compresses the oxidant 6 before it is preheated by the preheat heat exchanger 40. The oxidant 6 is then combusted with fuel 5 in the top cycle combustor 12 before being expanded in the top cycle expander 13, where the work done by the expanding gas is extracted as the power 7 shown exiting the cycle. Combustion exhaust heat 15 is then passed to the bottom cycle as it was in FIG. 1, whereas the combustion products are released as exhaust 8.

Figure 3:
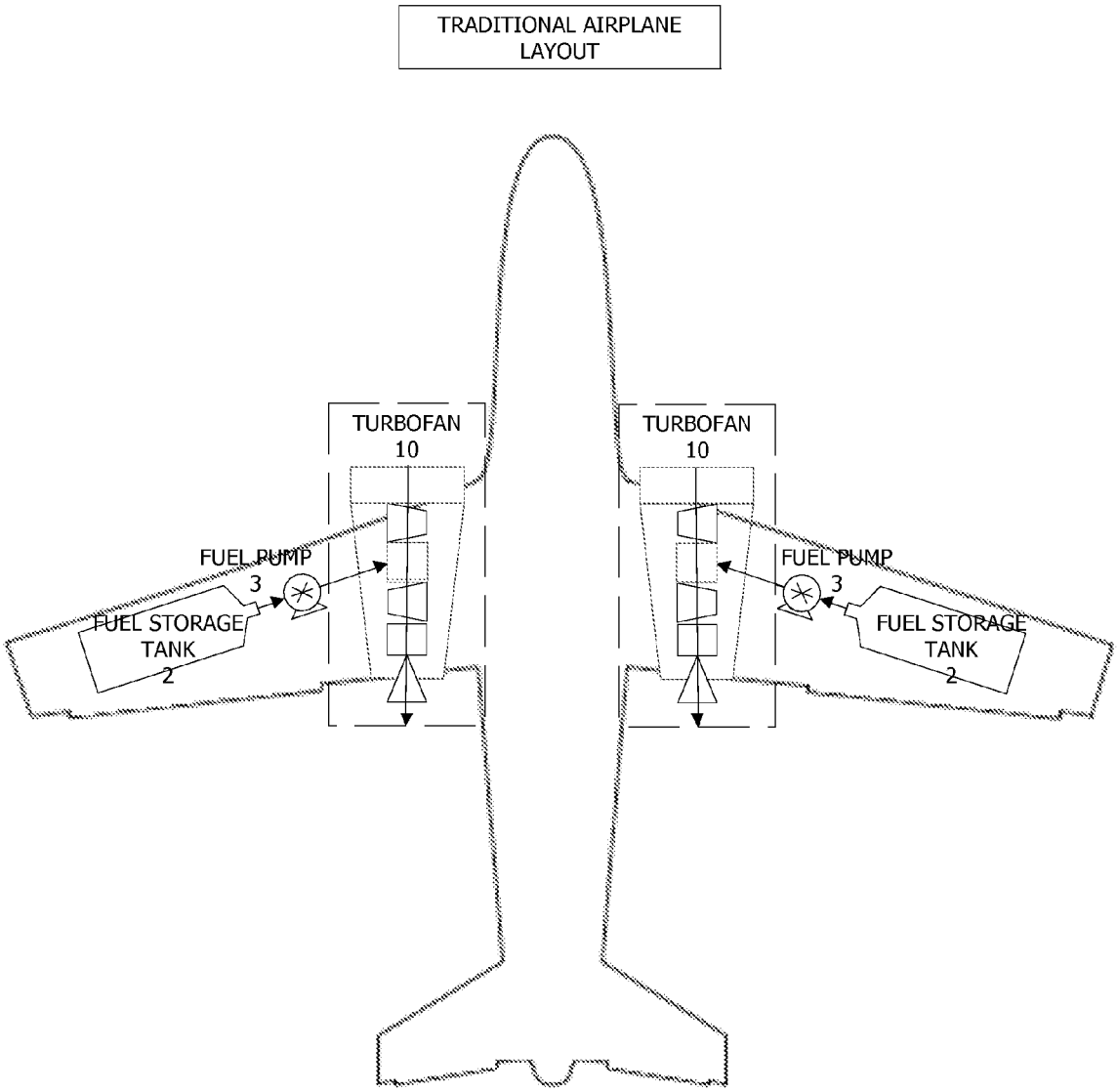
FIG. 3 is a diagram of a current jet fuel-burning commercial airliner layout.

FIG. 3 shows the layout of a typical commercial airliner using traditional jet fuel. The fuel 5 is stored in fuel storage tanks 2 in the wings of the airplane and is pumped via fuel pumps 3 into known in the art turbofan engines affixed to the wings. Since there is only one simple cycle, it cannot be referred to as a top or bottom cycle; however, these engines function much like the top cycle 10 of the Hybrid Airplane Combined Cycle Power Generation System, and are so labeled "10". The turbofans generate the thrust necessary to lift and propel the plane.

Figure 4:
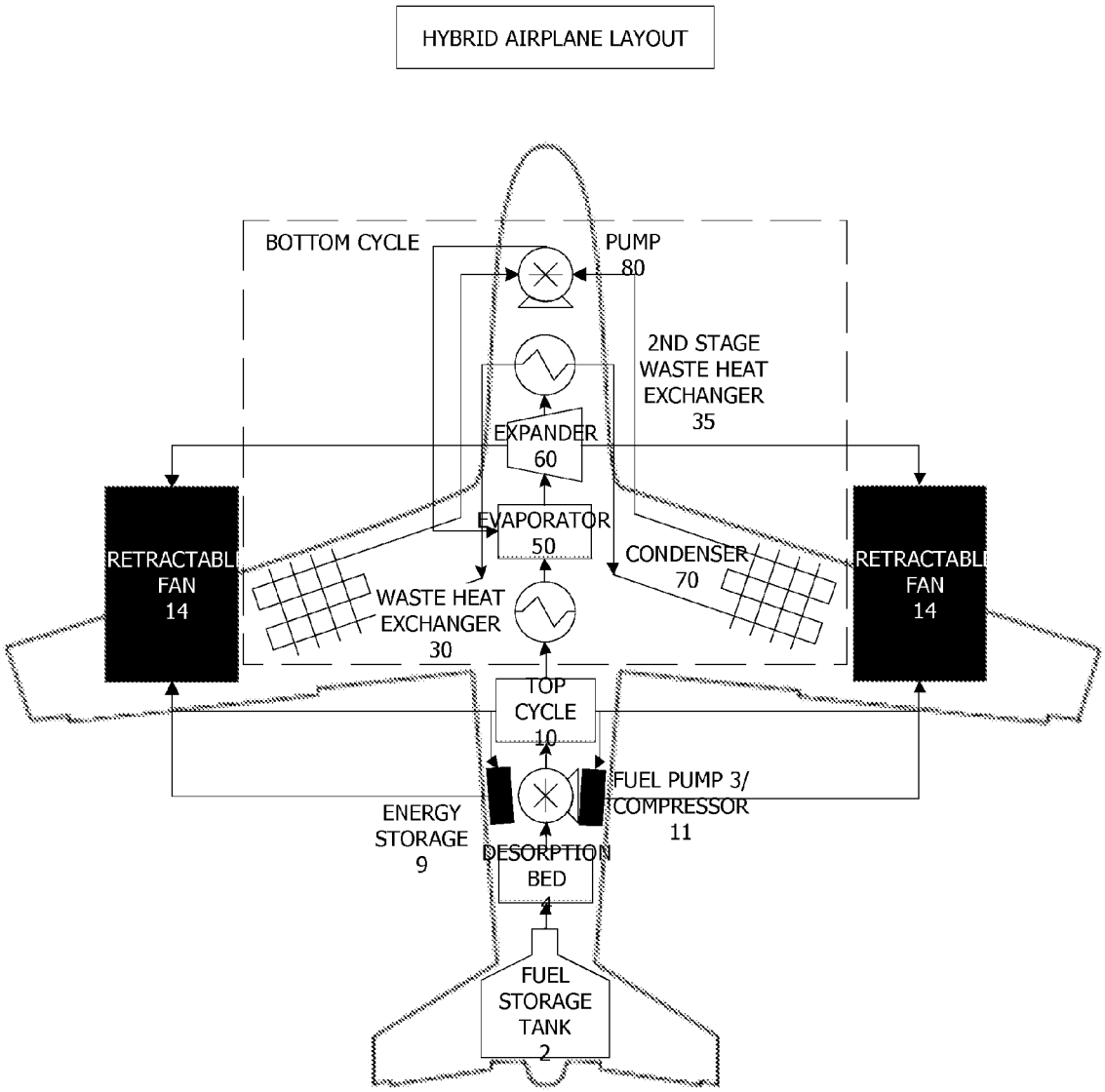
FIG. 4 is a diagram of the combined cycle power generation system layout within a hybrid airplane in accordance with the present invention.

FIG. 4 illustrates the layout of the present hybrid aircraft invention. Fuel 5 is stored toward the rear of the plane, in the tail and horizontal stabilizers in the preferred embodiment; the fuel storage tank 2 is here illustrated in the tail. Especially if hydrogen fuel is used, the rear of the plane, aft of any stored oxidant 6, is safer for fuel 5 storage. This would limit mixing of fuel 5 and oxidant 6 in the passenger section of the plane in the event of a crash landing in which the front portion of the plane would strike the ground first. Resulting flames are likely to project backwards as both the oxidant 6 and fuel 5 spray are likely to be projected rearward and any resulting desorbed hydrogen would also likely rise upwards, protecting the passengers or cargo.

A desorption bed 4 is shown in the scenario in which hydrogen fuel is used, which would preferably be stored as a metal hydride, though it is understood that a desorption bed 4 is unnecessary if hydrogen is not used or is stored in an alternative form. The desorption bed 4 would heat the metal hydride so that the adsorbed (i.e., weakly bonded) hydrogen is released. The desorbed hydrogen would then be compressed in a top cycle compressor 11 and used in the top cycle 10; if a traditional jet fuel is used, it will simply be pumped into the top cycle combustor 12 from the fuel storage tank 2 using a fuel pump 3 (after possible preheating). In the present figure, the fuel pump 3 illustrated is understood to be replaced by a compressor 11 if hydrogen fuel is used. Power 7 from this cycle is utilized by the retractable fans 14, which could be any known in the art turbofan or turboprop engine, or is stored in energy storage 9 for later use. Waste heat 15 from the top cycle 10 passes through the waste heat exchanger 30 illustrated in the center of the plane, where it is used to evaporate the bottom cycle's working fluid in the bottom cycle evaporator 50. Again, the bottom cycle is itself a simple thermodynamic cycle and is not novel. However, in the preferred embodiment, the fuselage of the airplane functions as the bottom cycle condenser 70. It is particularly preferred that the condenser 70 be located in the wings, ailerons, and horizontal stabilizers and specifically preferred that it be in the top side of the wings, ailerons, and horizontal stabilizers. This would allow heat to transfer out of the working fluid of the bottom cycle into the air above the wings 70, warming the air with the intended effect of decreasing pressure above the wing 70. As a result, more lift is generated, decreasing the fuel consumption necessary to keep the plane aloft. A de-icing system will also exist throughout the plane which draws heat from the second stage waste heat exchanger 35, but it is not shown in this figure.

Figure 5:
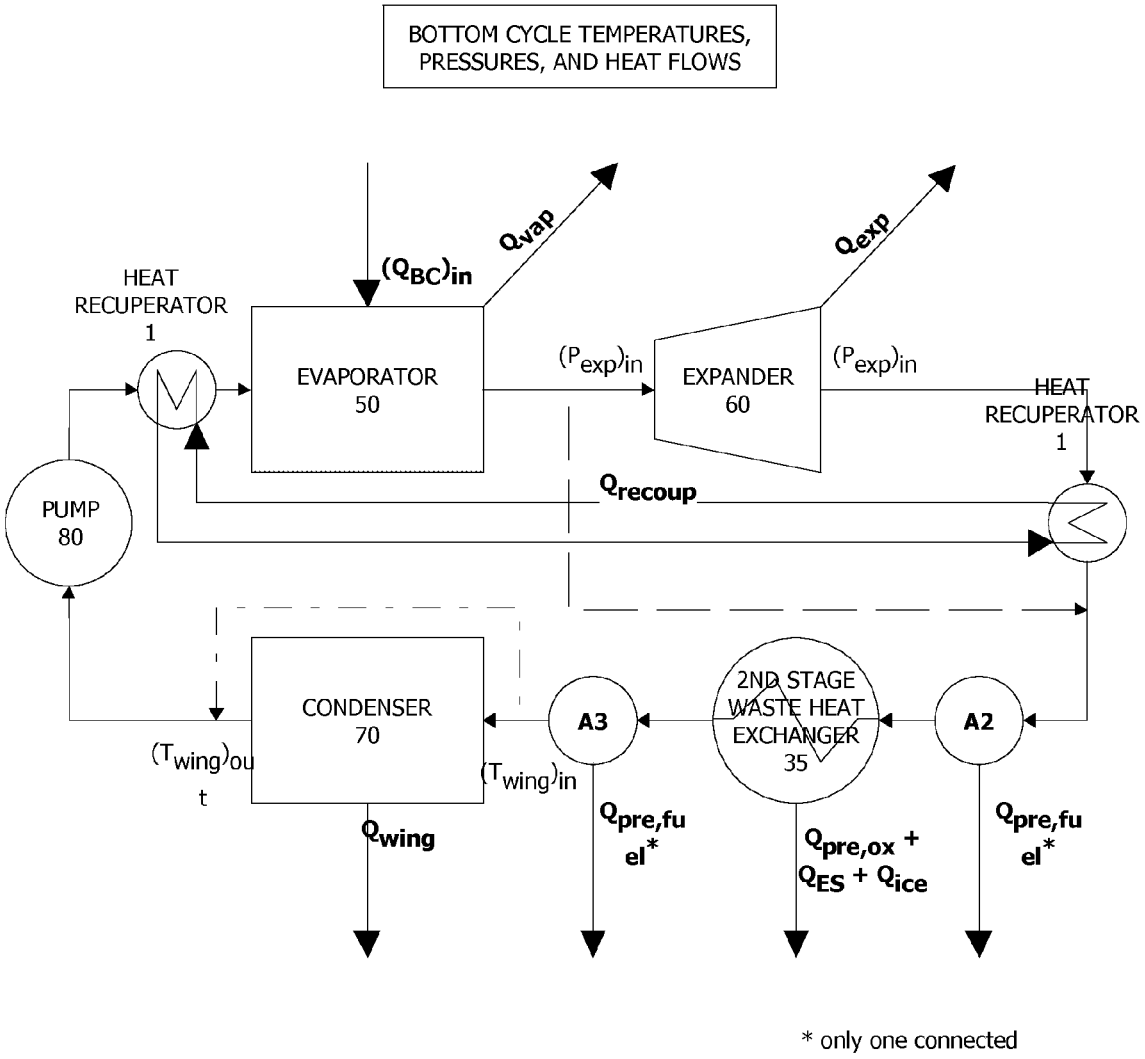
FIG. 5 is a schematic of the bottom cycle illustrating particular temperatures, pressures, and heat flows in accordance with the present invention.

FIG. 5 again shows the bottom cycle, but here also shows important temperatures, pressures, and heat transfers. A table summarizing the notations appearing in FIG. 5 and elsewhere is included below (Table 1). $(Q_{BC})_{in}$ is the heat transferred to the bottom cycle via the waste heat exchanger 30. $Q_{vap}$, shown exiting the bottom cycle evaporator 50, is the heat absorbed by the working fluid as it undergoes a phase transition from liquid to gas in a Rankine cycle. It is understood that if a Brayton cycle is utilized, the working fluid will not undergo a phase transition. $(P_{exp})_{in}$ and $(P_{exp})_{out}$ are the pressures at the bottom cycle expander 60 inlet and outlet, respectively. $Q_{exp}$, shown exiting the expander 60, is the heat lost by the working fluid as it expands. A recuperation heat exchanger 1 is shown following the expander 60, and this heat exchanger 1 is coupled with another before the evaporator 50. These heat exchangers 1 are for heat recuperation, i.e., the recycling of waste heat 15 from one part of the cycle for use elsewhere in the cycle. The recuperated heat is denoted as $Q_{recoup}$. After expansion, enough thermal energy must be removed from the working fluid such that it transitions to liquid before reaching the pump 80 (again assuming a Rankine cycle is used, as it is understood that such a transition is not necessary for a Brayton cycle). Therefore, heat extracted from the fluid after the expander 60 can be recuperated for use in the evaporator 50, helping to ensure the fluid is liquid post-condenser 70 and vapor pre-expander 60. The amount of heat recuperated is a fixed percentage of the amount passing through the recuperation heat exchanger 1, typically 70-95%.

TABLE 1

FIGURE Notations and Descriptions

| | Notation | Description |
|---|---|---|
| Root | T | temperature |
| | P | pressure |
| | Q | heat |
| | m | mass flow rate |
| Systems & Components | BC | bottom cycle |
| | WF | bottom-cycle working fluid |
| | exp | bottom-cycle expander |
| | fuel | fuel |
| | ox | oxidant |
| | pre, fuel | fuel preheater system |
| | pre, ox | oxidant preheater system |
| | ES | energy storage system |
| | ice | de-icing system |
| | wing | wing/condenser |
| | wat | water |
| Modifiers | vap | vaporization |
| | cond | condensation |
| | exp | expansion |
| | in | inlet |
| | out | outlet |
| | recoup | recuperated |
| | opt | optimum |
| | max | maximum |
| | lim | limit |
| | rem | remaining |
| | actual | actual |
| | loss | loss |
| | stor | storage |
| | auto | autoignition |
| | frz | freezing |
| | refuel | refueling |

Typical Structure: $(ROOT_{SYSTEM})_{modifier}$

Heat from the fluid can also be utilized for fuel 5 preheating, in which case it is removed as $Q_{pre,fuel}$ from either Point A2 or Point A3, respectively before or after the second stage waste heat exchanger 35. The asterisk next to $Q_{pre,fuel}$ indicates that only one of the two fuel 5 preheater connection points is used at any given time for heat removal, though it may reenter the bottom cycle at either point as permitted. Heat may also be removed to preheat the oxidant 6, denoted $Q_{pre,ox}$, and this heat is extracted at the second stage waste heat exchanger 35. The second stage waste heat exchanger 35 also transfers heat to energy storage 9, denoted as $Q_{ES}$, and to the de-icing system, with this heat denoted as $Q_{ice}$. Heat is transferred to energy storage 9 in order to maintain an optimal energy storage temperature and transferred to the de-icing system to remove ice from the plane and/or prevent ice formation.

Lastly, the wings, or condenser 70, release heat to the surrounding air, $Q_{wing}$, with the intended effect of increasing lift. The amount of heat radiated by the condenser 70 is not directly controllable, but it can be calculated and predicted using the mass flow rate of the working fluid, $\dot{m}_{WF}$ (which could be controlled by a variable speed pump); the working fluid temperature before the condenser 70, $(T_{wing})_{in}$; and the working fluid temperature after the condenser 70, $(T_{wing})_{out}$. The temperature after the condenser 70 is dependent upon the ambient air temperature, $T_{amb}$, as well as conditions such as the angle of attack (AOA), the density of air, velocity, and aileron conditions. The various points of heat removal are determined and adjusted by a fuel 5 preheating controller based on the amount of heat that must be removed to ensure the working fluid is liquid before reaching the pump 80. This process is described in FIG. 6.

Figure 6:
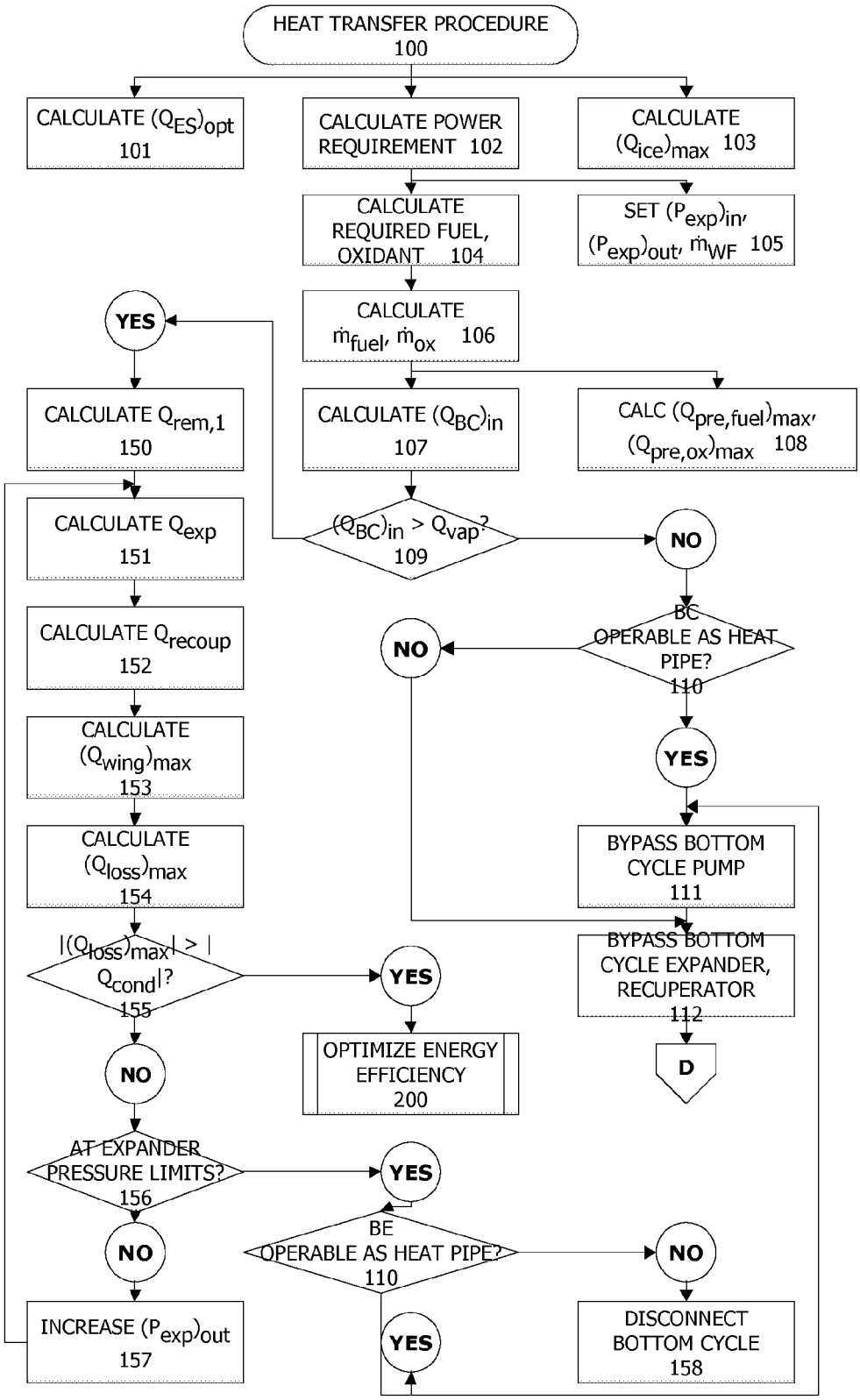
FIG. 6 is a flow chart illustrating the steps of the Heat Transfer Procedure in accordance with the present invention.

FIG. 6 describes the steps of the Heat Transfer Procedure 100 used to ensure the bottom cycle working fluid is liquid before reaching the pump 80 in a Rankine cycle. A flight management controller (not shown) could perform the required calculations. Conditions can also be predicted, using data such as that in FIG. 19 and Table 3, so that engine efficiency can be maximized under changing conditions, like when the plane changes altitude.

The flight management controller first performs three independent calculations: calculating the heat required to bring energy storage 9 to the optimal energy storage temperature 101, $(Q_{ES})_{opt}$; calculating the power requirement of the airplane 102; and calculating the heat required to bring the de-icing system to its maximum operating temperature 103, $(Q_{ice})_{max}$. $(Q_{ES})_{opt}$ is dependent on the mass of energy storage 9 and its current temperature. The maximum operating temperature of the de-icing system and thus $(Q_{ice})_{max}$ is dependent on the current temperature of the system and the temperature limits of the component. The power requirement of the airplane is dependent on how much lift and thrust are needed. Based on the projected power requirement, the amount of fuel 5 and oxidant 6 required can be calculated 104, and the bottom cycle working fluid mass flow rate, $\dot{m}_{WF}$; the bottom cycle expander inlet pressure, $(P_{exp})_{in}$; and the bottom cycle expander outlet pressure, $(P_{out})_{in}$, can be set 105. The determination of the required fuel 5 and oxidant 6 allows for the calculation of $\dot{m}_{fuel}$ and $\dot{m}_{ox}$, their respective flow rates 106. These, in turn, allow for the calculation of the heat that enters the bottom cycle 107, $(Q_{BC})_{in}$, and the maximum amounts of heat that can be used in preheating 108 fuel 5 and oxidant 6, $(Q_{pre,fuel})_{max}$ and $(Q_{pre,ox})_{max}$, respectively. $(Q_{pre,fuel})_{max}$ is also influenced by the fuel 5 autoignition temperature, $(T_{fuel})_{auto}$. Oxidant 6, on the other hand, has no temperature at which it will spontaneously combust. It is understood that energy storage 9 systems include batteries, capacitors, ultracapacitors, etc. and further as known in the art that electrical energy storage 9 systems have minimum operating temperatures. Therefore it is advantageous to energy storage 9 systems to limit cold temperature operation through the utilization of nominal amounts of thermal energy, such as that available in the form of waste heat 15 from thermodynamic cycles.

The first check in the Heat Transfer Procedure 100 is whether the heat entering the bottom cycle is enough to vaporize the working fluid 109. If not, another check is performed as to whether the bottom cycle is operable as a known in the art heat pipe 110, meaning that the working fluid will circulate without the use of the bottom cycle pump 80. If the bottom cycle can function as a heat pipe, the bottom cycle pump 80 is bypassed 111. Regardless of ability to operate as a heat pipe, the bottom cycle expander 60 and recuperators 1 are bypassed 112 before reaching Reference Point D, which leads to the continuation of the Heat Transfer Procedure 100 in FIG. 7.

If there is enough heat to vaporize the working fluid at the first check, several calculations are made, the first of which is how much heat remains 150 after vaporizing the working fluid. A table of all the remaining heat calculations, Table 2, is provided below for reference. It should be noted that all remaining heat calculations are numbered "150", but remaining heat comparisons, i.e., the decisions following the calculations, are not numbered identically. After calculating how much heat remains, the amount of heat absorbed by the working fluid during expansion, $Q_{exp}$, is calculated 151. Next, the amount of heat recuperated can be calculated 152, as this is dependent on the temperature after expansion. Based on the temperature at the condenser 70 inlet, which is in turn based on the amount of recuperated heat, energy storage 9 heating, fuel 5 and oxidant 6 preheating, and de-icing (all of which have been previously calculated), the amount of heat that can be radiated by the wings, $(Q_{wing})_{max}$, can be calculated 153. The last calculation before the next decision is the maximum amount of heat that can be utilized 154, $(Q_{loss})_{max}$, which is the sum of all previous heat losses (Table 2) with each term maximized (or optimized in the case of energy storage 9 heating). It is understood that the use of "radiated" energy is not literally the dissipation of thermal energy by the process of radiation, but rather interchangeable with the term dissipating energy. In virtually all instances in this invention, thermal dissipation of heat will take place through convection between the exterior surface (i.e., wing 70) and the moving air (i.e., external moving fluid). Secondary heat transfer will take place through conduction between the thermodynamic cycle working fluid (i.e., heat exchanger) and exterior surface with further heat spreading of the thermal energy as known in the art.

TABLE 2

Remaining Heat Calculations

| Notation | Description |
|---|---|
| $Q_{loss}$ | $\lvert Q_{loss}\rvert = \lvert Q_{vap}\rvert + \lvert Q_{exp}\rvert + \lvert Q_{recoup}\rvert + \lvert Q_{pre,fuel}\rvert + \lvert Q_{pre,ox}\rvert + \lvert Q_{ES}\rvert + \lvert Q_{ice}\rvert + \lvert Q_{wing}\rvert$ |
| $Q_{rem,1}$ | $\lvert Q_{rem,1}\rvert = \lvert (Q_{BC})_{in}\rvert - \lvert Q_{vap}\rvert - \lvert Q_{exp}\rvert$ |
| $Q_{rem,2}$ | $\lvert Q_{rem,2}\rvert = \lvert (Q_{BC})_{in}\rvert - \lvert (Q_{ES})_{opt}\rvert$ |
| $Q_{rem,3}$ | $\lvert Q_{rem,3}\rvert = \lvert Q_{rem,2}\rvert - \lvert (Q_{pre,fuel})_{max}\rvert - \lvert (Q_{pre,ox})_{max}\rvert = \lvert (Q_{BCin}\rvert - \lvert (Q_{ES})_{opt}\rvert - \lvert Q_{in,BC}\rvert - \lvert (Q_{ES})_{opt}\rvert$ |
| $Q_{rem,4}$ | $\lvert Q_{rem,4}\rvert = \lvert Q_{rem,1}\rvert - \lvert Q_{recoup}\rvert = \lvert (Q_{BC})_{in}\rvert - \lvert Q_{vap}\rvert - \lvert Q_{exp}\rvert - \lvert Q_{recoup}\rvert$ |
| $Q_{rem,5}$ | $\lvert Q_{rem,5}\rvert = \lvert Q_{rem,4}\rvert - \lvert (Q_{ES})_{opt}\rvert = \lvert (Q_{BC})_{in}\rvert - \lvert Q_{vap}\rvert - \lvert Q_{exp}\rvert - \lvert Q_{recoup}\rvert - \lvert (Q_{ES})_{opt}\rvert$ |
| $Q_{rem,6}$ | $\lvert Q_{rem,6}\rvert = \lvert Q_{rem,5}\rvert - \lvert (Q_{pre,fuel})_{max}\rvert - \lvert (Q_{pre,ox})_{max}\rvert = \lvert (Q_{BC})_{in}\rvert - \lvert Q_{vap}\rvert - \lvert Q_{exp}\rvert - \lvert Q_{recoup}\rvert - \lvert (Q_{ES})_{opt}\rvert - \lvert (Q_{pre,fuel})_{max}\rvert - \lvert (Q_{pre,ox})_{max}\rvert$ |

The next check is whether the magnitude of $(Q_{loss})_{max}$ is greater than the magnitude of the heat of condensation, $Q_{cond}$, of the working fluid 155, i.e., whether or not the maximum amount of heat that can be removed from the working fluid is enough to liquefy it. If so, the bottom cycle is in operable conditions, and the continuing procedure is described in the Heat Transfer Optimization Procedure 200, FIG. 8. If $\lvert (Q_{loss})_{max}\rvert$ is not greater than $\lvert Q_{cond}\rvert$, then a check is performed to see whether or not the expander 60 is at its rated pressure limits 156. If not, the expander outlet pressure, $(P_{exp})_{out}$, can be increased 157 to create a liquid prior to pump 80, allowing $Q_{exp}$ to be recalculated 151 and the logic flow to continue from that point. If the expander 60 is at its pressure limits, then its outlet pressure cannot be adjusted, and so a check is again performed to see whether the bottom cycle is operable as a heat pipe 110. If so, the bottom cycle pump 80 is bypassed 111 and the bottom cycle expander 60 and recuperators 1 are bypassed 112, allowing a hot vapor to flow through the bottom cycle transmitting heat; the process then continues at Reference D in FIG. 7. If not, then the working fluid cannot circulate, meaning it cannot radiate heat to the other systems, and enough heat cannot be radiated to ensure the working fluid is liquid before the pump 80. Therefore, the bottom cycle must be disconnected 158 to prevent cavitation of the pump 80 and to prevent the working fluid from continuing to increase in temperature.

Figure 7:
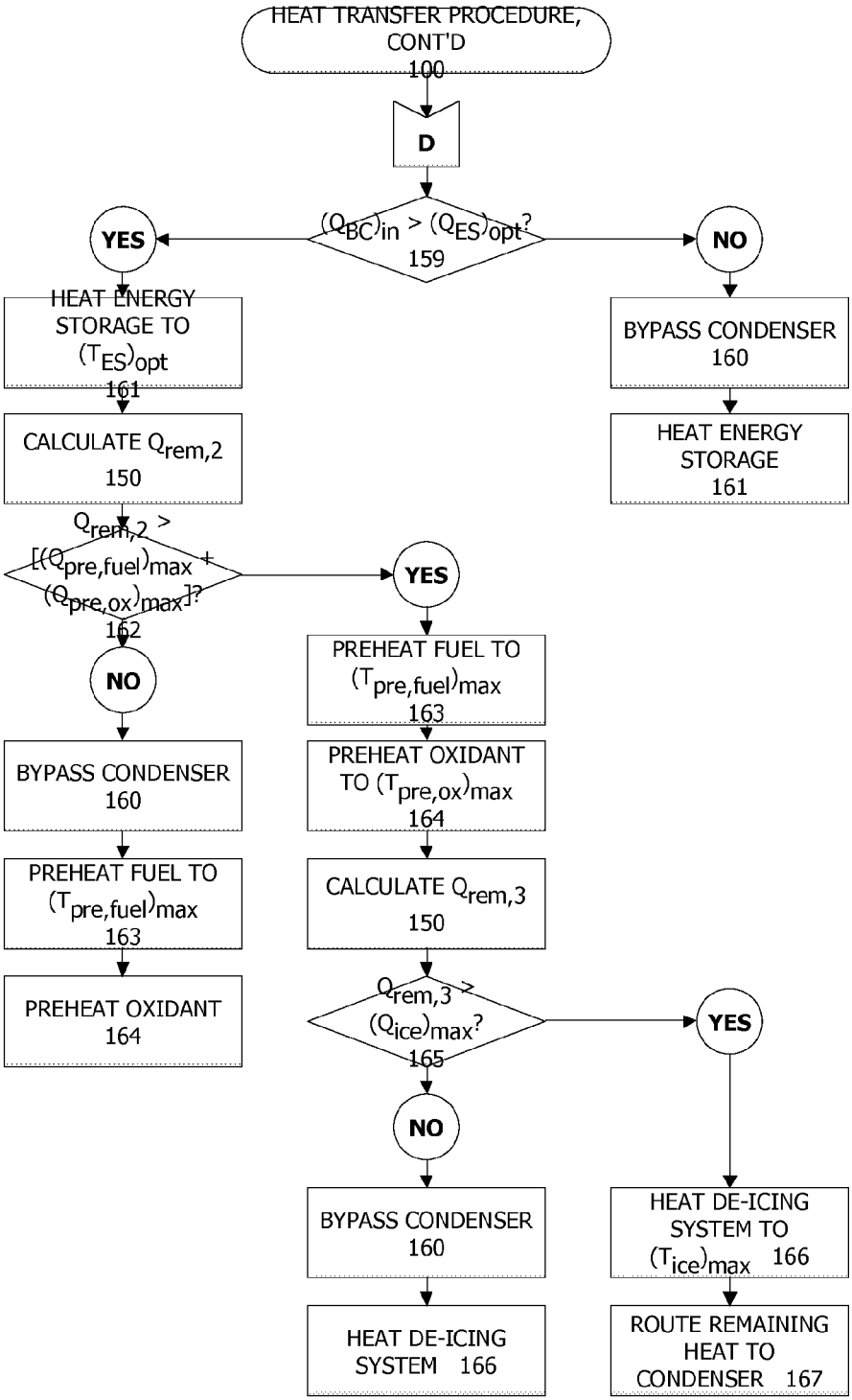
FIG. 7 is a flow chart illustrating the steps of the Heat Transfer Procedure, continued from Reference Point D of FIG. 6, primarily describing the scenario in which insufficient heat enters the bottom cycle to vaporize the working fluid in accordance with the present invention.

FIG. 7 is a continuation of FIG. 6 beginning at Reference Point D. FIG. 7 describes the situations in which either (a) insufficient heat enters the bottom cycle to vaporize the working fluid or (b) enough heat enters the bottom cycle to vaporize the working fluid but not enough capacity exists to return it to a liquid state prior to the pump 80, though the bottom cycle is operable as a heat pipe. After the bottom cycle expander 60 and recuperators 1 have been bypassed 112, a check is performed to determine whether the heat entering the bottom cycle is greater than that required to heat energy storage 9 to its optimum temperature 159, $(T_{ES})_{opt}$, with the required heat denoted as $(Q_{ES})_{opt}$. If not, the condenser 70 is bypassed 160 and energy storage 9 is heated 161 as much as possible with the heat entering the bottom cycle. If there is sufficient heat to bring energy storage 9 to its optimum temperature, then energy storage 9 is heated 161 to $(T_{ES})_{opt}$ and the remaining heat, $Q_{rem,2}$, is calculated 150, as defined in Table 2.

This remaining heat is then compared to the amount of heat required to preheat the fuel 5 and oxidant 6 to their maximum preheating values 162. If the remaining heat is not greater than that required to bring both to their maximum preheating temperatures, $(Q_{pre,fuel})_{max}+(Q_{pre,ox})_{max}$, then the condenser 70 is bypassed 160, the fuel 5 is preheated 163 to its maximum preheating temperature, and any remaining heat is used to preheat the oxidant 6 to the maximum attainable temperature 164. It is understood that if there is insufficient heat to preheat the fuel 5 to its maximum preheating temperature, then the oxidant 6 is not preheated while all available heat is used for fuel 5 preheating. If there is enough heat remaining after heating energy storage 9 to bring both the fuel 5 and oxidant 6 to their maximum preheating temperatures, each is brought to its respective maximum temperature before the remaining heat is again calculated 150 according to Table 2, this time $Q_{rem,3}$.

The last check is whether this remaining heat is enough to bring the de-icing system to its maximum operating temperature 165, with this heat denoted as $(Q_{ice})_{max}$. If not, the condenser 70 is bypassed 160 and the de-icing system is simply heated 166 with any remaining heat. If there is sufficient heat to heat the de-icing system to its maximum operating temperature, $(T_{ice})_{max}$, then it is brought to $(T_{ice})_{max}$ 166 before any remaining heat is routed 167 through the condenser 70.

Figure 8:
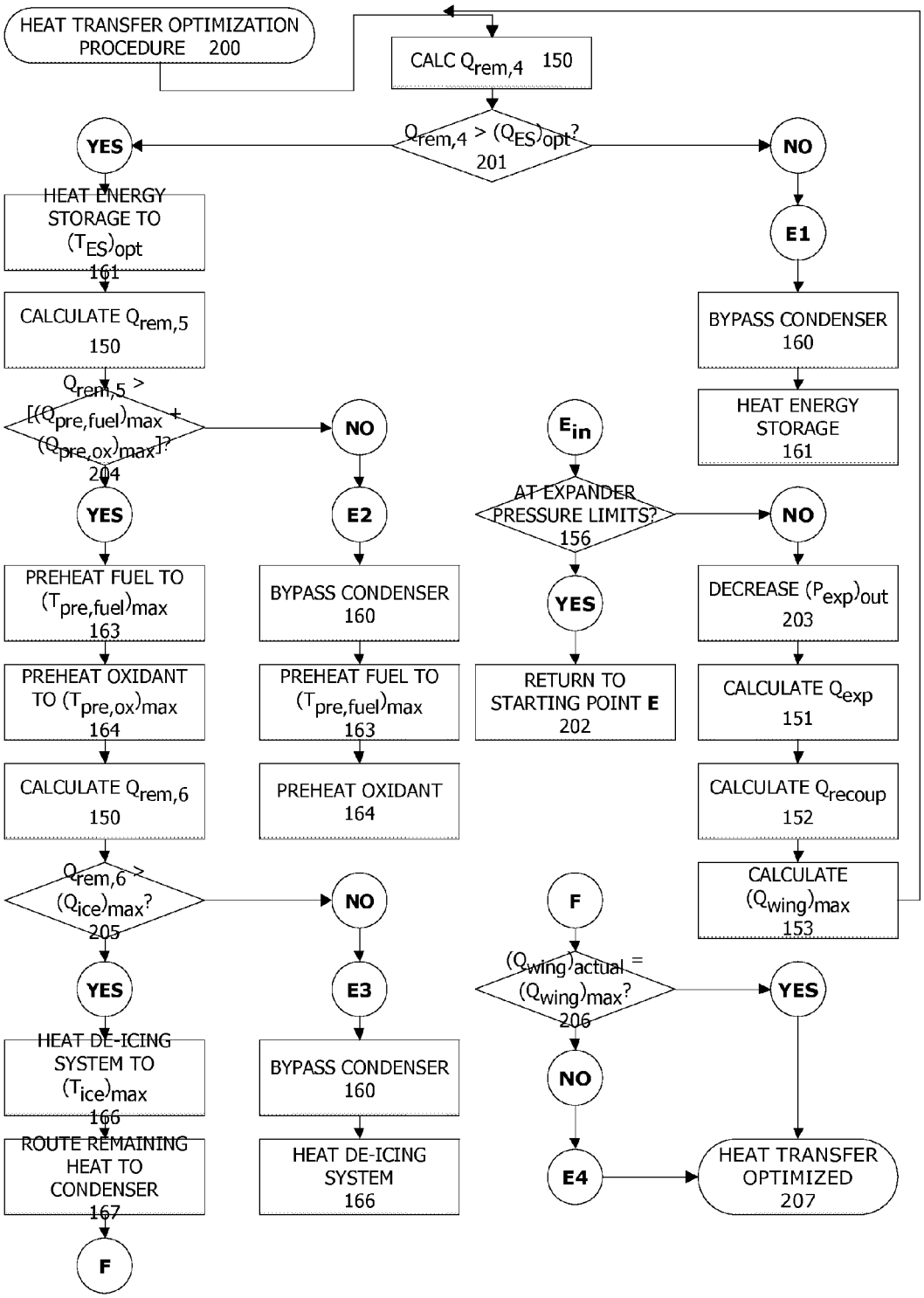
FIG. 8 is a flow chart illustrating the steps of the Heat Transfer Optimization Procedure, referenced in FIG. 6, in accordance with the present invention.

FIG. 8 describes the Heat Transfer Optimization Procedure 200 that is performed when there is sufficient heat entering the bottom cycle to vaporize the working fluid and enough heat loss capacity to return it to a liquid prior to the pump 80. The purpose of this procedure is to utilize the full heat loss capacity of the wings 70. The Heat Transfer Optimization Procedure 200 is very similar to the continuation of the Heat Transfer Procedure 100, but it has additional checks so that the expander 60 pressure ratio can be optimized; this cannot be performed in the Heat Transfer Procedure 100 because, in that situation, the expander 60 has been bypassed. As previously mentioned, these calculations can also be performed in advance knowing how conditions will change, allowing adjustments to be made to maintain the highest possible efficiencies. FIG. 19 and Table 3 contain information used in these predictions. The controller utilizes a predictive control method to anticipate changes in vehicle conditions, such that proper/safe operating conditions are virtually always maintained, particularly pressure and temperature conditions downstream of the condenser 70. Such changes include altitude, angle of attack, aileron position, landing gear position, velocity, etc. and other conditions as known in the art to influence air flow (i.e., laminar, boundary layer, etc.) and heat transfer rates between the exterior surface and the external moving fluid.

After calculating the remaining heat 150, $Q_{rem,4}$, a check is performed to determine whether or not the remaining heat is sufficient to heat energy storage 9 to its optimum temperature 201. If not, Reference Point E1 is reached. Like the preheater system Connection Points A, multiple Reference Points E exist, each with a different index number. All lead to Reference Point $E_{in}$ toward the middle right-hand side of the page. The check after $E_{in}$ is whether or not the expander 60 is at its pressure limits 156. If so, the output pressure cannot be lowered to increase power, so the system returns to the starting Point E 202, i.e., the reference point that led to $E_{in}$, in this case Point E1. From there, the condenser 70 is bypassed 160, and energy storage 9 is heated 161 as much as possible. However, if the expander 60 is not at its pressure limits, its output pressure can be lowered 203 (creating a larger pressure gradient and allowing more energy to be extracted during expansion), the new heat loss due to expansion can be calculated 151, $Q_{recoup}$ can be recalculated 152, the amount of heat radiated by the wings 70 can be recalculated 153, and the Heat Transfer Optimization Procedure 200 can begin again. Thus, power 7 output is increased.

If $Q_{rem,4}$ was originally greater than the heat required to bring energy storage 9 to its optimum temperature, energy storage 9 is heated 161 to $(T_{ES})_{opt}$ and $Q_{rem,5}$ is calculated 150. From there, a check is performed to see whether or not this remaining heat is enough to preheat both the fuel 5 and oxidant 6 to their maximum preheating temperatures 204. If not, the logic again feeds into Point $E_{in}$, whose logical process is carried out as it was described earlier. Again, if the expander 60 is at its pressure limits, the system returns to the initial Reference E, in this case E2. The condenser 70 is then bypassed 160, the fuel 5 is preheated 163 to $(T_{pre,fuel})_{max}$, and the oxidant 6 is preheated 164 with any remaining heat. It is again understood that if there is insufficient heat to bring the fuel 5 to $(T_{pre,fuel})_{max}$, the fuel 5 is preheated 163 with all available heat while the oxidant 6 is not preheated. If sufficient heat was available to bring both fuel 5 and oxidant 6 to their maximum preheating temperatures, fuel 5 is preheated 163, oxidant 6 is preheated 164, and the remaining heat, $Q_{rem,6}$ is calculated 150.

A check as to whether $Q_{rem,6}$ is enough to bring the de-icing system to its maximum operating temperature 205 is then performed. If not, the system jumps to $E_{in}$ and carries out the procedure accordingly. If it must return to E3, the condenser 70 is again bypassed 160, and the de-icing system is heated 166 with all remaining heat. If sufficient heat is present, the de-icing system is brought to its maximum operating temperature 166, and any remaining heat is routed 167 to the condenser 70. The procedure then continues at Reference Point F. A check is performed to determine if the amount of heat radiated by the wings 70 is equal to the maximum possible heat radiation capacity 206. This can be determined using the values for $(T_{wing})_{in}$ and $(T_{wing})_{out}$ to calculate the actual heat loss, then comparing this result to the theoretical heat loss calculated earlier, $(Q_{wing})_{max}$, which is calculated by the flight management controller using $(T_{wing})_{in}$, $T_{amb}$, $\dot{m}_{WF}$, and flight information such as angle of attack. If they are equal, heat transfer has been optimized 207. If not, the system once more jumps to $E_{in}$. This may lead back to the starting Point E, in which case the heat transfer is optimized 207, or it may result in $(P_{exp})_{out}$ being decreased 203, in which case the Heat Transfer Optimization Procedure 200 begins again.

FIGS. 9-12 are meant to elaborate on safety precautions and temperature thresholds for processes occurring in the Heat Transfer Procedure 100 and Heat Transfer Optimization Procedure 200 (FIGS. 6-8). They supersede the earlier figures and establish when certain processes should be bypassed; for instance, fuel 5 and oxidant 6 preheating do not occur during takeoff and landing. Another example is if the Heat Transfer Procedure 100 states that fuel 5 should be preheated but the working fluid is of insufficient temperature, in which case the Fuel Preheating Procedure 400 creates a bypass so that the heat 15 can be used elsewhere. These figures are also meant to show the hierarchy of waste heat 15 usage: Waste heat 15 is routed first to energy storage 9, then to fuel 5 preheating, oxidant 6 preheating, de-icing, and finally the condenser 70. This hierarchy is also apparent in FIG. 6 through FIG. 8.

Figure 9:
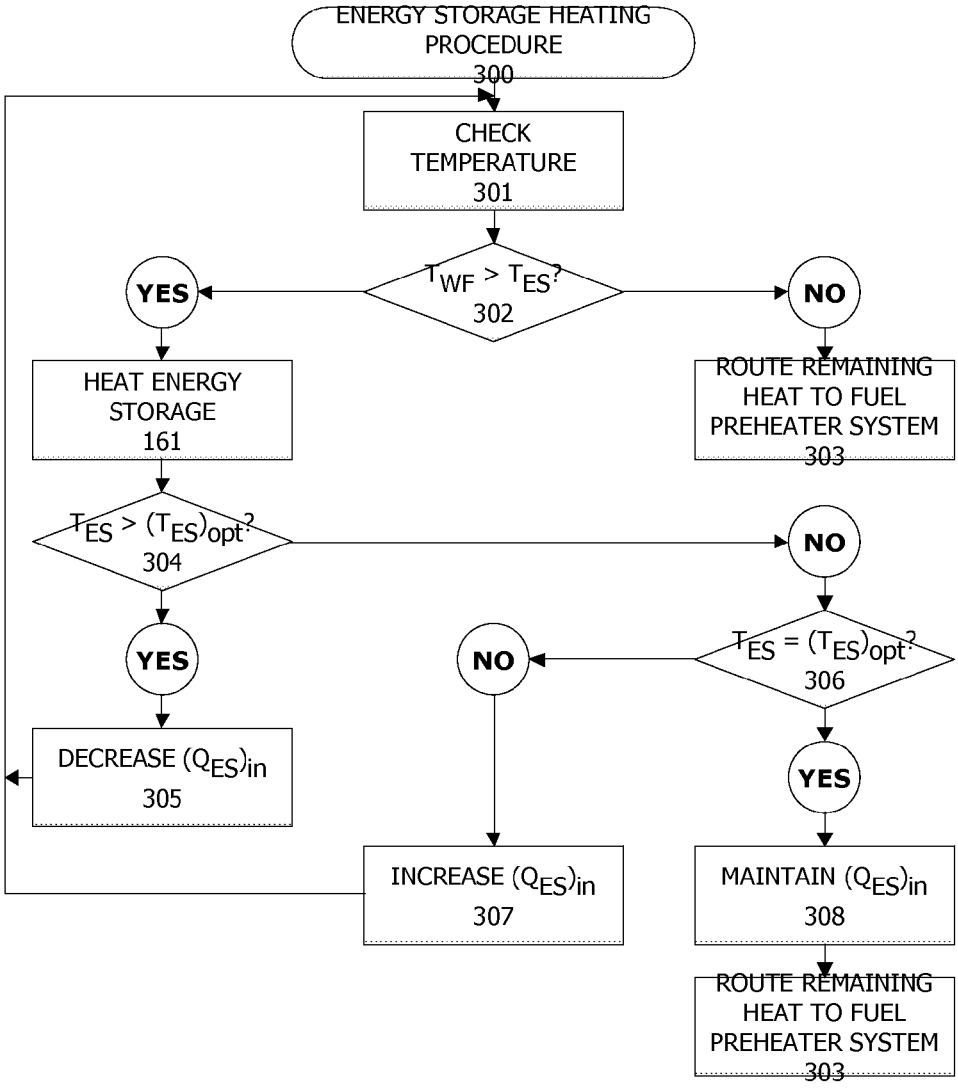
FIG. 9 is a flow chart illustrating the steps of the Energy Storage Heating Procedure in accordance with the present invention.

FIG. 9 illustrates the Energy Storage Heating Procedure 300. The first temperature check 301 is to determine whether the working fluid temperature, $T_{WF}$, is greater than the current energy storage 9 temperature 302, $T_{ES}$, as the fluid passes through the second stage waste heat exchanger 35. If not, heat cannot be transferred to energy storage 9 without performing work, so the waste heat 15 is transferred instead to the fuel 5 preheater system 303. If the working fluid is of sufficient temperature, energy storage 9 heating begins 161, and a check is performed to determine whether energy storage 9 is above its optimum temperature 304. If so, the amount of heat used for energy storage 9 heating, $(Q_{ES})_{in}$, is decreased 305, and the procedure begins again. If the energy storage 9 temperature does not exceed the optimum temperature, a final check is performed to see whether the energy storage 9 temperature is optimized 306. The amount of heat used for energy storage 9 heating is increased 307 if the optimum temperature has not yet been reached but is held constant 308 as soon as it has been. Any heat remaining after reaching $(T_{ES})_{opt}$ is passed to the fuel preheater system 303.

Figure 10:
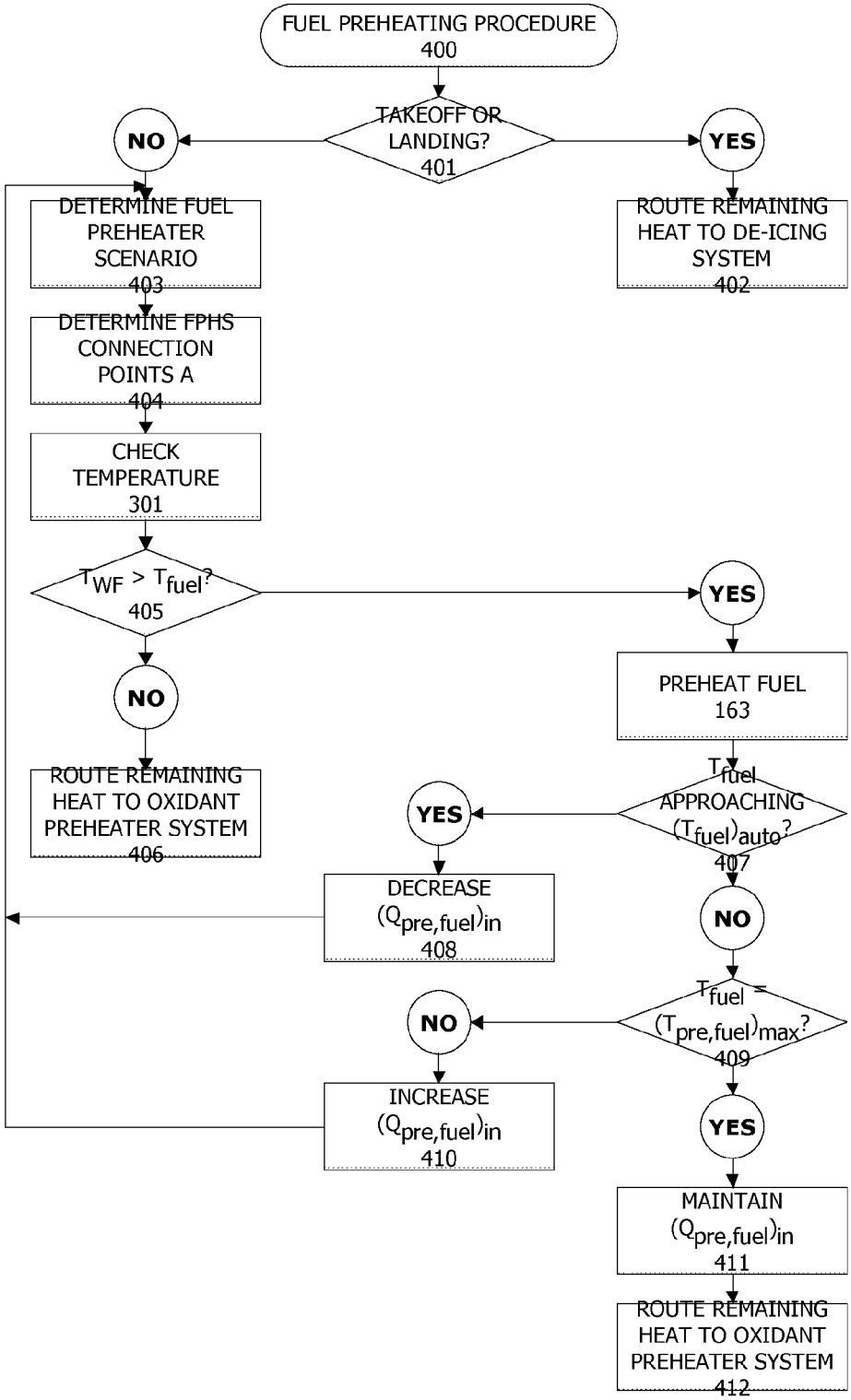
FIG. 10 is a flow chart illustrating the steps of the Fuel Preheating Procedure in accordance with the present invention.

FIG. 10 describes the steps of the Fuel Preheating Procedure 400. Since fuel 5 is not typically preheated during takeoff or landing, the first decision determines whether or not either of these conditions is true 401. When taking off or landing, waste heat 15 is typically routed past both the fuel 5 and oxidant 6 preheater systems to the de-icing system 402. At all other times, fuel 5 will be preheated, so the fuel 5 preheater arrangement must be chosen 403, which is done by a fuel 5 preheating controller. The four fuel 5 preheater scenarios are described in FIGS. 13-16. Once the scenario is determined 403, the fuel 5 preheater system (here abbreviated "FPHS") Connection Points A must be determined 404, also by the fuel 5 preheating controller. The scenario and connection points are determined using the amount of remaining heat after energy storage 9 heating, current fuel 5 and oxidant 6 temperatures, and ambient conditions. Without being bound by theory, avoiding the preheating of fuel 5 and/or oxidant 6 during takeoff or landing is to maintain the safest operating conditions, or in the landing scenario to maintain the safest conditions for staff on the ground (i.e., including conditions for refueling of fuel 5, or adding oxidant 6).

Once the scenario and connection points have been determined, a temperature check 301 is performed to ensure the temperature of the fuel 5 is below that of the working fluid 405. If not, heat cannot be transferred passively from the working fluid to the fuel 5, and so the fuel 5 preheater system is bypassed, routing the working fluid through the oxidant preheater system 406 instead for oxidant 6 preheating. The fuel 5 is preheated 163 if the working fluid is of sufficient temperature, and the following decision ensures that the fuel is not approaching its autoignition temperature 407, $(T_{fuel})_{auto}$, at which point it would ignite without a spark. Preferably the fuel 5 will not come within 17% of its autoignition temperature, though it is particularly preferred it remain at least 13% below $(T_{fuel})_{auto}$ and specifically preferred it remain at least 9% below $(T_{fuel})_{auto}$. If the autoignition temperature is approached, the amount of heat entering the fuel 5 preheater system is decreased 408; the preheater scenario 403 and connection points may also be readjusted 404 before temperature is rechecked 301.

If the autoignition temperature is not approached, a check is performed to determine if the fuel 5 is yet at its maximum preheating value 409. This temperature, $(T_{pre,fuel})_{max}$, is determined using the fuel 5 mass flow rate, which places a physical limit on how much heat can be transferred to the fuel 5; the fuel 5 type; and the autoignition temperature, which is approached to within some percent. This cutoff is preferred to be 18% below the fuel autoignition temperature, particularly preferred to be 14% below, and specifically preferred to be 10% below. Though the autoignition temperature is figured into $(T_{pre,fuel})_{max}$, the previous check is included for safety and to highlight its significance. If the maximum preheating value is not yet reached, i.e., the fuel 5 has not been preheated to the safety limit, the heat entering the fuel 5 preheater system is increased 410, which again may involve adjusting the scenario 403 and connection points 404. If the preheating limit is reached, the amount of heat entering the fuel 5 preheater system is maintained 411, and remaining heat is routed to the oxidant 6 preheater system 412.

It is anticipated within this invention that the controller will preferentially utilize energy from the energy storage 9, over additional fuel 5 usage as "refueling" (i.e., electrically charging of the energy storage 9) is typically less expensive from electricity that is generated on the ground versus moving (i.e., in the air, on the ocean, etc.).

Figure 11:
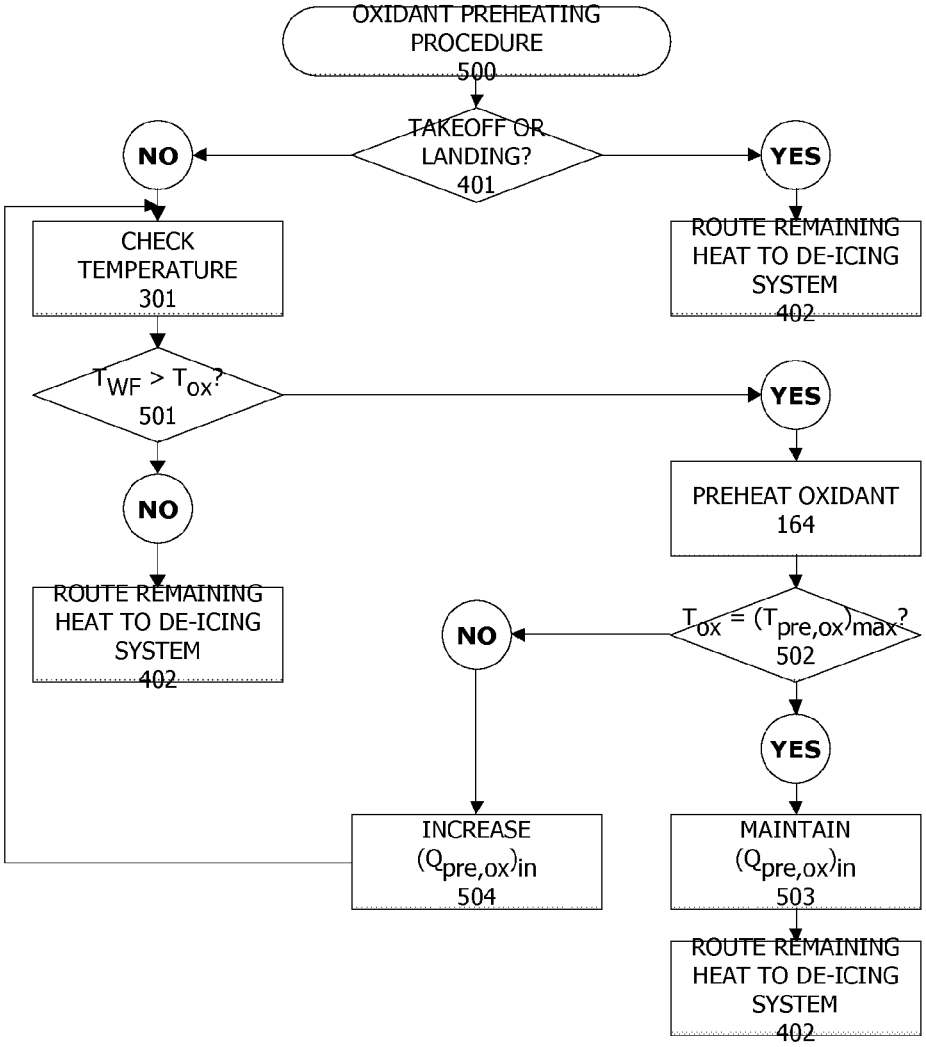
FIG. 11 is a flow chart illustrating the steps of the Oxidant Preheating Procedure in accordance with the present invention.

FIG. 11 explains the logic of the Oxidant Preheating Procedure 500. Like the Fuel Preheating Procedure 400, this procedure is not performed during takeoff and landing, and so the first decision determines if either is taking place 401. The oxidant 6 preheater system is bypassed and all remaining waste heat 15 routed to the de-icing system 402 if taking off or landing. If not, a temperature check 301 is performed to see whether the working fluid temperature is sufficient to heat the oxidant 6 without additional work 501. Waste heat 15 is routed to the de-icing system 402 if the working fluid temperature is not great enough, but oxidant 6 is preheated otherwise. A check is then performed to see if the oxidant 6 has reached its maximum preheating temperature 502. Unlike fuel 5, oxidant 6 cannot autoignite, and so the only factor limiting the amount of preheating is the oxidant 6 mass flow rate. If the oxidant 6 has reached its maximum preheating temperature, the amount of heat entering the oxidant 6 preheater system is maintained 503 while any remaining heat is routed to the de-icing system 402. Otherwise, $(Q_{pre,ox})_{in}$ is increased 504, and the first temperature check 301 is performed again to see if the working fluid is still of sufficient temperature to continue to preheat the oxidant 6.

Figure 12:
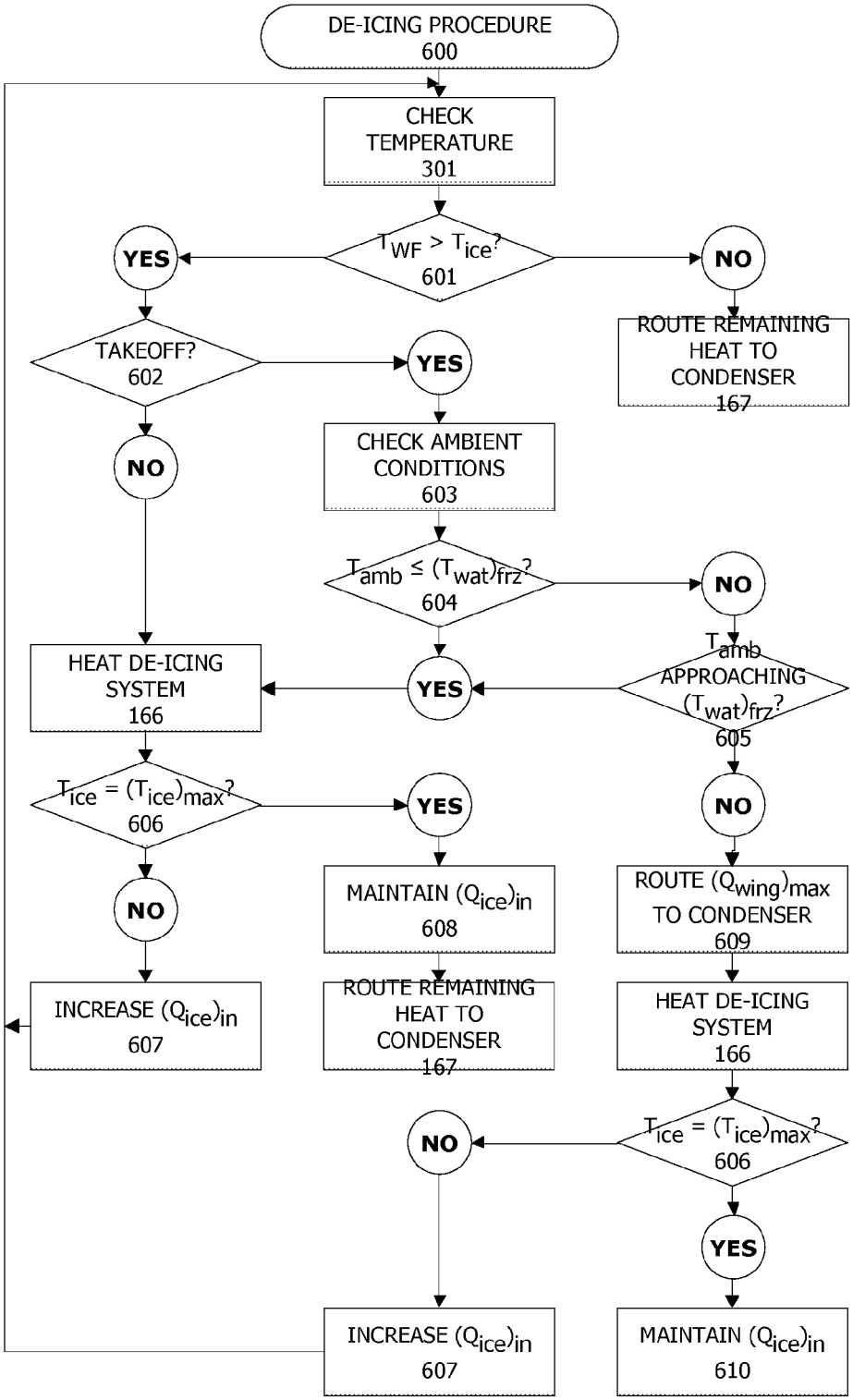
FIG. 12 is a flow chart illustrating the steps of the De-Icing Procedure in accordance with the present invention.

FIG. 12 illustrates the steps of the De-Icing Procedure 600. The first is a temperature check 301 to determine if the working fluid is of sufficient temperature to heat the de-icing system without additional work being performed 601. If not, remaining heat is routed 167 to the condenser 70, but if so, a check is performed to determine if the plane is taking off 602. During takeoff, it may be more desirable to generate extra lift by heating the wings 70, decreasing fuel 5 consumption. If the plane is indeed taking off, ambient conditions must be checked 603, for if freezing or near-freezing conditions exist on or near the ground, de-icing still takes priority. Two checks are performed to determine if the ambient temperature is (a) at or below the freezing point of water 604 or if ambient temperature is (b) approaching water's freezing point 605. Ambient temperature is considered "approaching" the freezing point preferably if it is within 11%, though it is particularly preferred "approaching" is within 9% and specifically preferred it is within 7%. If at, below, or approaching water's freezing point, de-icing takes priority, and the de-icing system is heated 166. This same point is reached without checking ambient conditions 603 if the plane is not taking off, for in this case de-icing is always preferable to added lift. Another check is then performed to determine if the de-icing system is at its maximum temperature 606. This temperature limit is defined by the maximum operating temperatures of the system's various components; it is preferred the components not come within 12% of their maximum operating temperature, particularly preferred they not come within 10% of their maximum operating temperature, and specifically preferred they not come within 8% of their maximum operating temperature. If the system has not yet been maxed out, the heat entering the de-icing system is increased 607 and the temperature check 301 performed again. If the system has reached its maximum temperature, the heat entering is maintained 608 and the remaining heat routed 167 to the condenser 70.

If the plane is taking off but ambient conditions are well above freezing (i.e., checks 604 and 605 are both "no"), it is preferable to generate excess lift rather than heating the de-icing system. In this case, the maximum amount of heat the condenser 70 can dissipate is routed 609 to the condenser 70. This preferably heats the air above the wings 70, generating lift by increasing the pressure gradient between the bottoms and tops of the wings 70. The de-icing system is then heated 166 with any remaining heat. (Due to the layout of the system, the de-icing system is in practice heated first with the amount of heat that cannot be radiated by the condenser 70, but logically the procedure describes heating the condenser 70 first.) The temperature is checked to see if it is yet at the maximum 606 and can be increased 607 until this temperature is achieved. Once it is, the heat entering the de-icing system is maintained 610. The temperature cannot exceed the maximum because the bottom cycle has already been disconnected 158 if there is too much heat to be dissipated by this point (i.e., after both the condenser 70 and de-icing system have been used).

Figure 13:
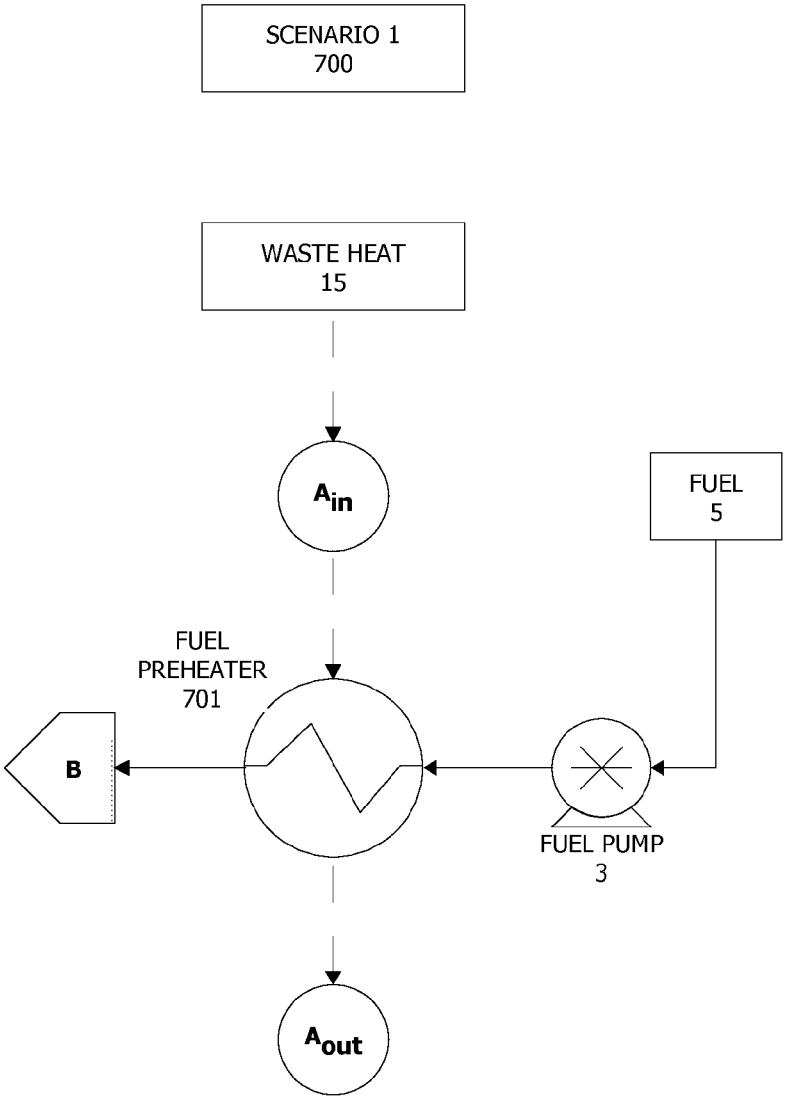
FIG. 13 is a schematic showing the first of four possible layouts of the fuel preheater system in accordance with the present invention.

FIG. 13 shows the first of four possible arrangements of the fuel 5 preheater system, Scenario 1 700. In this arrangement, only fuel 5 is preheated. Waste heat 15 enters at a Point A, denoted as $A_{in}$, and is passed through the fuel preheater 701, not shown in FIGS. 1-2. Heat is then transferred to the fuel 5, which in the figure is pumped by a fuel pump 3 from the right-hand side, before the fuel 5 exits the preheater system and enters the top cycle 10 at Point B of FIGS. 1-2. The now lower-temperature exhaust 8 heat exits the preheater system via Point $A_{out}$, which may be the same point as $A_{in}$ or another Point A of greater index.

Figure 14:
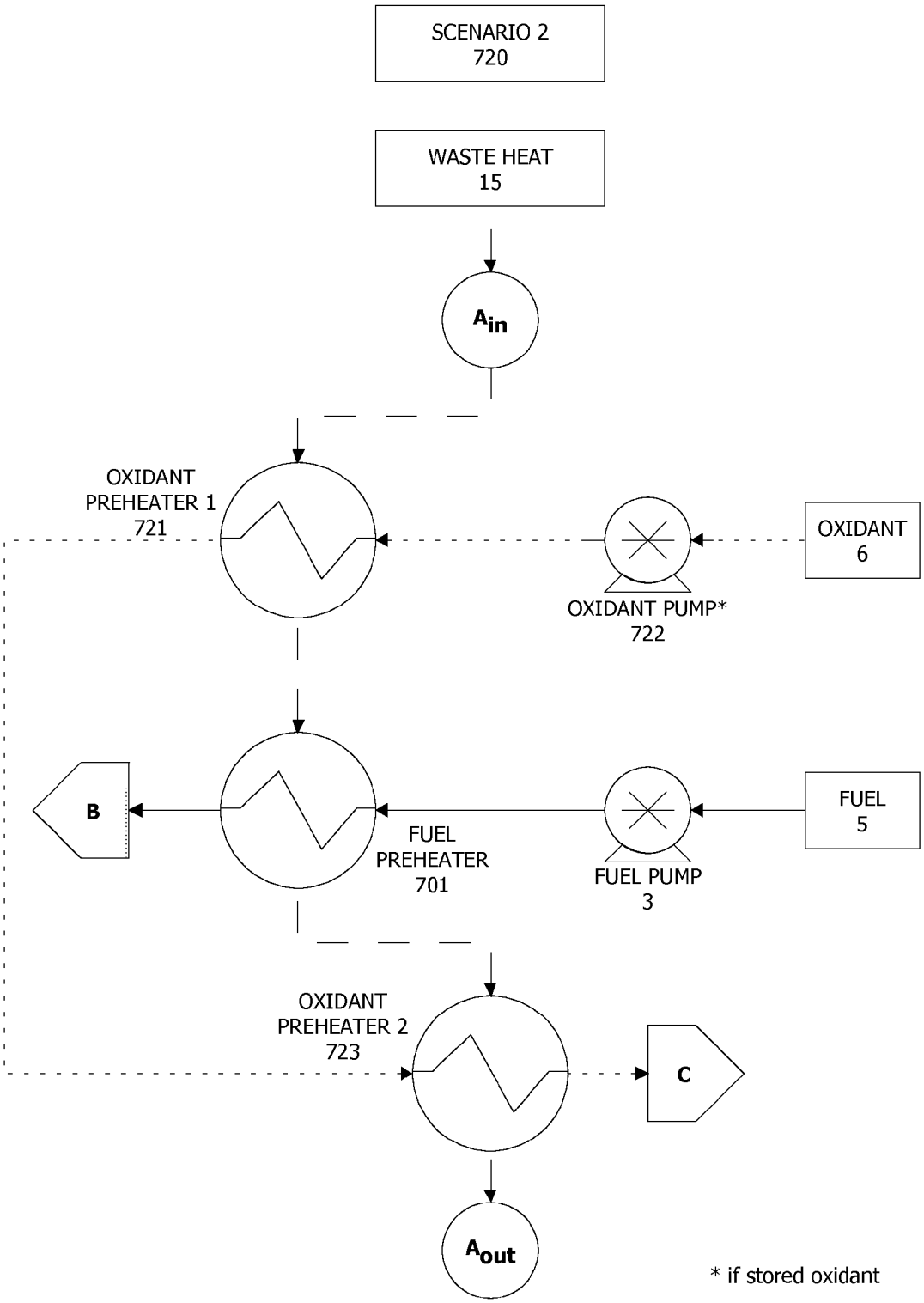
FIG. 14 is a schematic showing the second of four possible layouts of the fuel preheater system in accordance with the present invention.

FIG. 14 shows the second of four possible arrangements of the fuel 5 preheater system, Scenario 2 720. In this arrangement, both fuel 5 and oxidant 6 are preheated. Waste heat 15 again enters at a Point A and passes through a heat exchanger, this time a first oxidant preheater 721. The preheater 721 may in practice be the preheat heat exchanger 40 or some other heat exchanger not shown in FIGS. 1-2. This first heat exchanger 721 allows heat transfer to the oxidant 6, illustrated as being pumped from the right-hand side of the page by an oxidant pump 722. It is understood that if there is no oxidant 6 storage, the oxidant 6 will simply flow into the system via an air intake without the use of pump 722, as noted by the asterisk. The leftover heat from this exchange is then used to preheat the fuel 5 in a fuel preheater 701 before the fuel 5 is combusted in the top cycle combustor 12, having entered the top cycle 10 at Point B. Remaining heat is then used to further preheat the oxidant 6 at a second oxidant preheater 723 (which again could be the preheat heat exchanger 40) before the oxidant 6 enters the top cycle 10 at Point C. Waste heat 15 is then transferred to some Point A.

Figure 15:
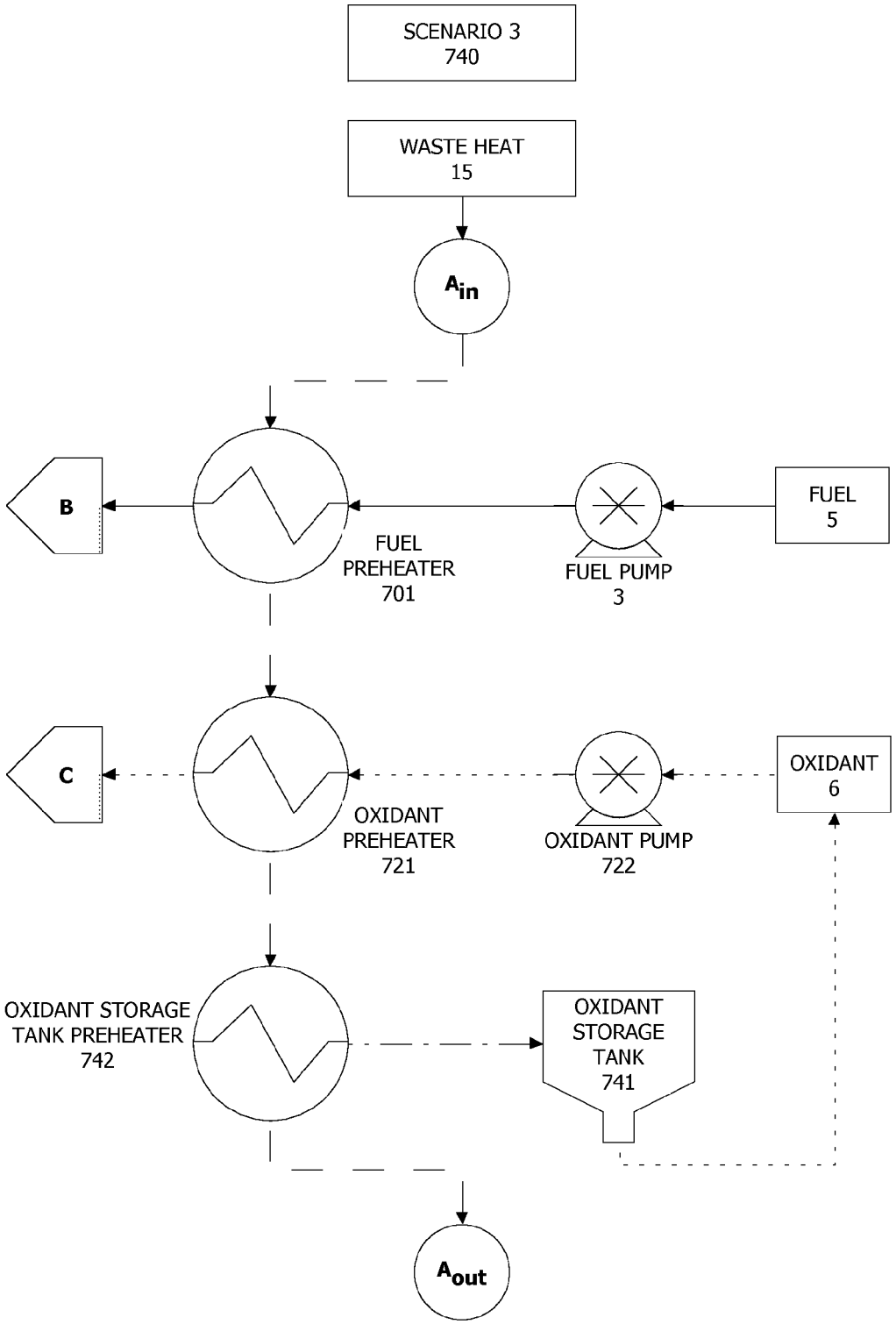
FIG. 15 is a schematic showing the third of four possible layouts of the fuel preheater system in accordance with the present invention.

FIG. 15 shows the third of four possible arrangements of the fuel 5 preheater system, Scenario 3 740. For this scenario, the hybrid airplane must store oxidant 6 rather than obtain it from the atmosphere. Waste heat 15 enters the preheater system from a Point A and is first used to preheat fuel 5. This fuel 5 is pumped from the fuel storage tank 2 (not shown) and through the fuel preheater 701 before entering the top cycle 10 at Point B. Waste heat 15 then continues to the oxidant preheater 721. Oxidant 6 is pumped by oxidant pump 722 through the preheater 721 from an oxidant storage tank 741 before entering the top cycle 10 at Point C. Remaining heat passes through an oxidant storage tank preheater 742 used to preheat the oxidant storage tank 741 before remaining waste heat 15 exits the preheater system to a Point A. An alternating dotted-dashed line is used to show that heat is transferred to the oxidant storage tank 741 without exhaust gas 8 flowing through the tank 741.

Figure 16:
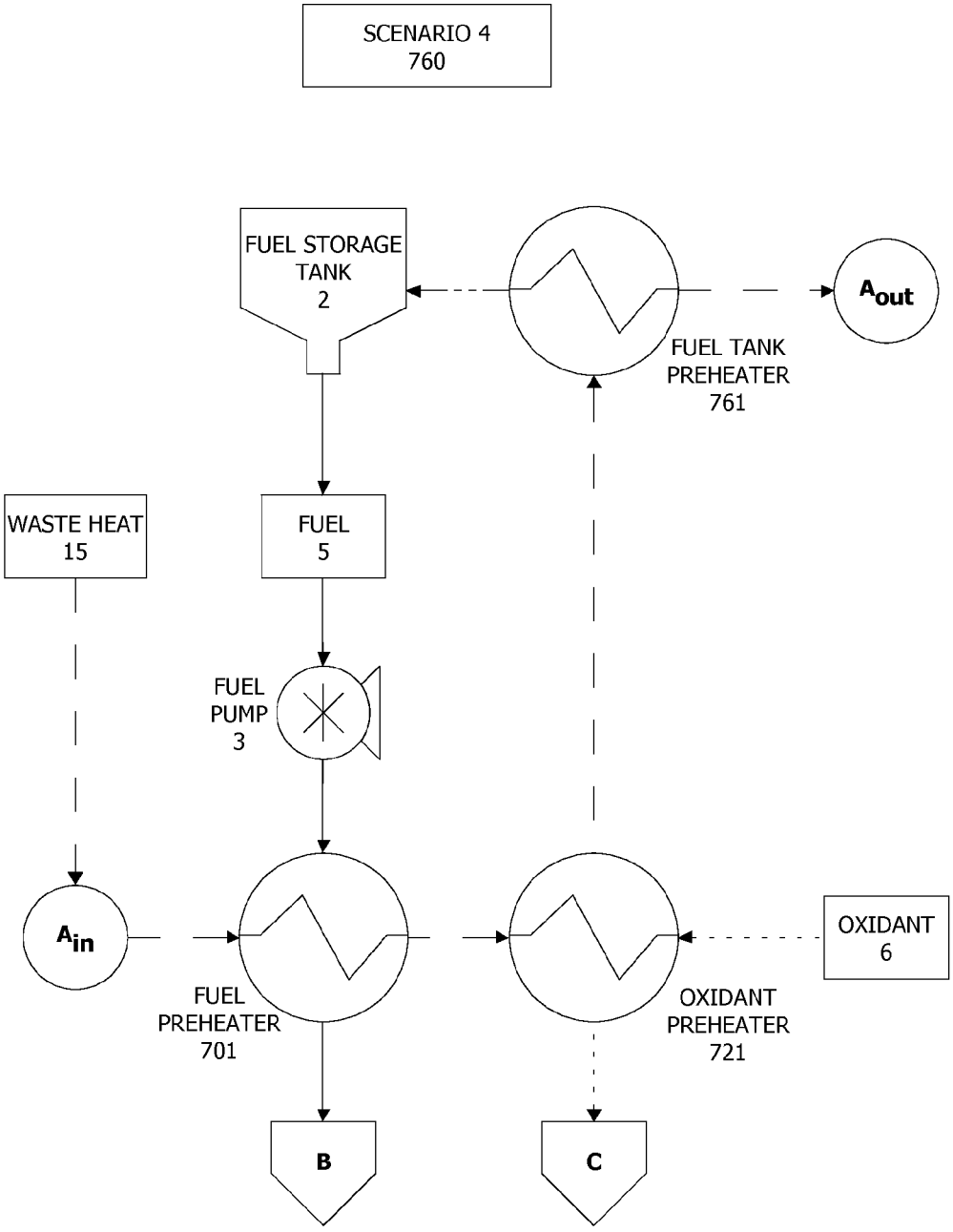
FIG. 16 is a schematic showing the fourth of four possible layouts of the fuel preheater system in accordance with the present invention.

FIG. 16 shows the fourth of four possible arrangements of the fuel 5 preheater system, Scenario 4 760. In this arrangement, fuel 5 is pumped from the fuel storage tank 2 to a fuel preheater 701, where waste heat 15 entering the heat exchanger 701 from a Point A preheats the fuel 5. This preheated fuel 5 then enters the top cycle 10 at Point B. Waste heat 15 continues to the oxidant preheater 721 to preheat the oxidant 6. Oxidant 6 enters the preheater 721, gains heat from the exhaust 8, and is then used in the top cycle 10, which it enters at Point C. Remaining waste heat 15 continues to a fuel tank preheater 761 where it is used to preheat the fuel storage tank 2. Again, an alternating dashed line is used to show that heat is transferred between the heat exchanger 761 and the tank 2 without the two being in series. For safety, the fuel storage tank 2 temperature cannot rise above the vapor point of jet fuel if traditional jet fuel is used or above the desorption temperature of the metal hydride used to store hydrogen if hydrogen fuel is used. These safety procedures are described in FIG. 17. After preheating the fuel storage tank 2, remaining heat exits the preheater system to a Point A.

Figure 17:
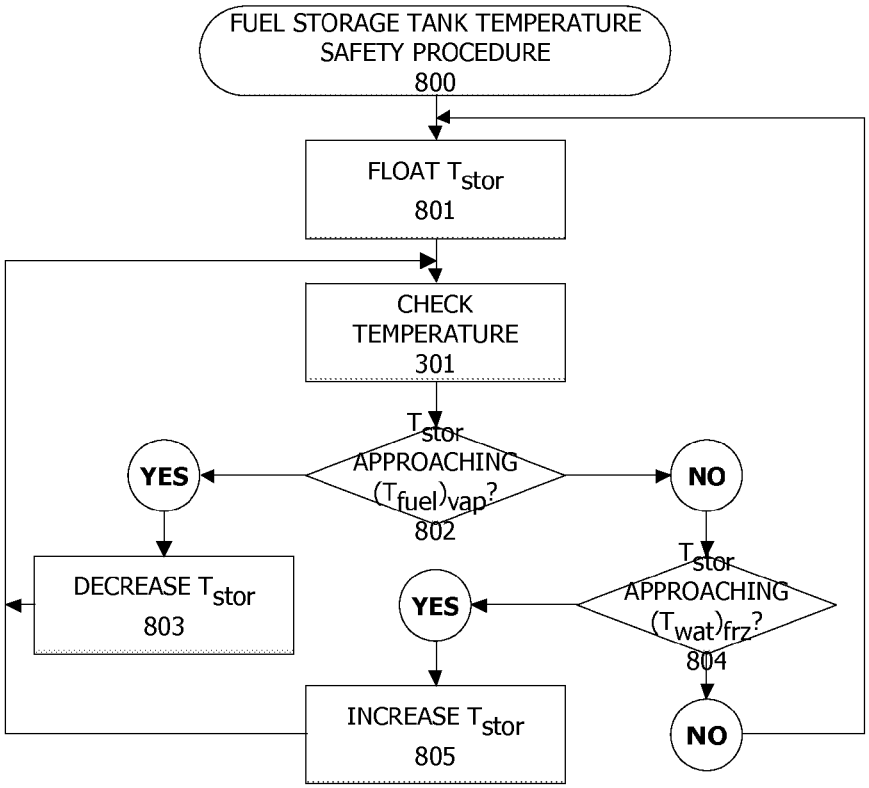
FIG. 17 is a flow chart illustrating the steps of the Fuel Storage Tank Temperature Safety Procedure in accordance with the present invention.

FIG. 17 illustrates the logic of the Fuel Storage Tank Temperature Safety Procedure 800. The storage temperature, $T_{stor}$, is originally allowed to float 801, or vary with atmospheric conditions. The temperature is then checked 301 to see if it is approaching the fuel 5 vaporization temperature 802, $(T_{fuel})_{vap}$. It is preferred that the storage temperature remains at least 12% below the vaporization temperature, particularly preferred it remains at least 10% below the vaporization temperature, and specifically preferred it remains at least 8% below the vaporization temperature. If the temperature is approaching that of vaporization, the tank 2 temperature is decreased 803 before the temperature is checked 301 again. If the vaporization temperature is not approached, a check is also performed to determine if the fuel 5 storage temperature is approaching the water freezing point 804. This is to prevent ice from forming in the tank 2 or fuel 5 line, as was the case with British Airways Flight 38. If the water freezing temperature is approached, the fuel 5 storage temperature must be increased 805 before checking it again. It is preferred the fuel storage tank 2 temperature remains at least 10% above water's freezing point, particularly preferred temperatures do not fall below 8% above water's freezing point, and specifically preferred the temperature does not come within 6% of water's freezing point. If neither temperature limit is approached, the storage temperature continues to float 801.

It is understood that if hydrogen fuel is used, the first decision is replaced with one checking if the storage temperature is approaching the metal hydride's desorption temperature. It is preferred the temperature remains at least 12% below the desorption temperature, particularly preferred it remains at least 10% below the desorption temperature, and specifically preferred it remain at least 8% below the desorption temperature. It is further understood that if hydrogen fuel is used, the second decision is irrelevant since ice formation would not affect fuel 5 delivery, assuming a metal hydride is used. In this case, temperature is allowed to float 801 as long as the desorption temperature is not approached in the storage tank 2.

Figure 18:
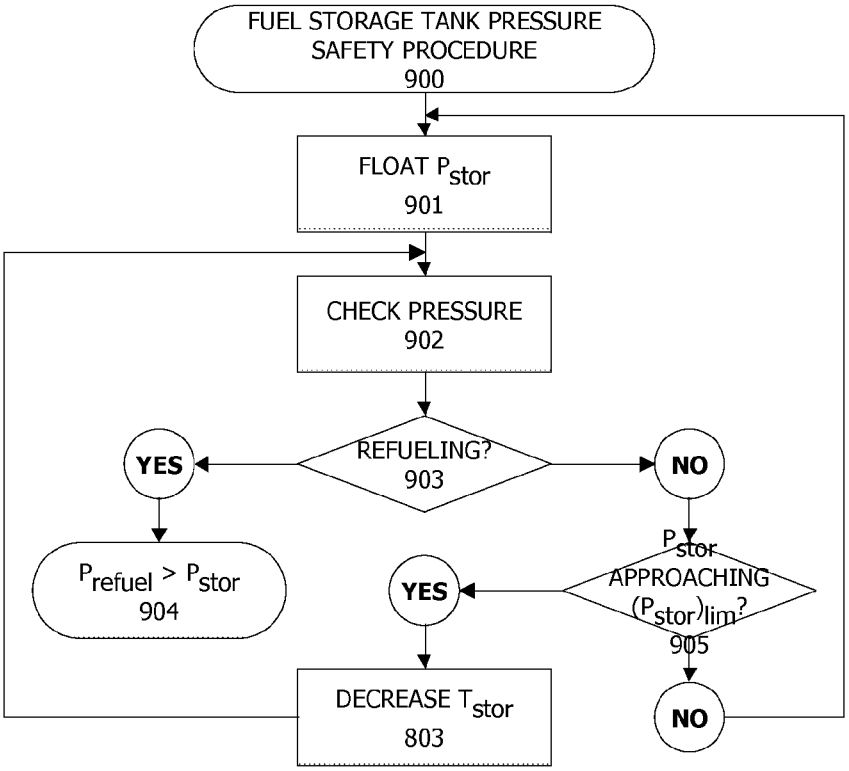
FIG. 18 is a flow chart illustrating the steps of the Fuel Storage Tank Pressure Safety Procedure in accordance with the present invention.

FIG. 18 shows the steps of the Fuel Storage Tank Pressure Safety Procedure 900. As in the Temperature Safety Procedure 800 (FIG. 17), the storage pressure, $P_{stor}$, is originally allowed to float 901. The first pressure check 902 determines if the plane is being refueled 903. If so, the refueling pressure must be greater than the storage pressure 904 so that fuel 5 flows into the tank 2. This is also the case for hydrogen fuel, where the re-hydriding pressure must be greater than the storage pressure. If the plane is not refueling, a check is performed to determine if the storage pressure is approaching the storage pressure limit 905, $(P_{stor})_{lim}$, at which point the tank 2 would rupture. It is preferred that the tank 2 pressure remain at least 10% below the limit, particularly preferred it remain at least 8% below the limit, and specifically preferred it remain at least 6% below the limit. If the pressure limit is approached, the tank 2 temperature is decreased 803 since temperature and pressure are directly related; the pressure is then checked 902 again. If the pressure limit is never approached, the pressure continues to float 901.

FIG. 19 is a standard altitude table taken from Aerodynamics for Naval Aviators by H. H. Hurt, Jr. (Naval Air Systems Command, 1965). This table can be used to predict the ambient air temperature at a given altitude, allowing the amount of heat radiated by the condensers 70 to be approximated. This, in turn, can be used to determine which fuel 5 preheater scenarios and connections to utilize as well as the working fluid mass flow rate and other variables.

Table 3 below is an example of the data the flight management controller would use in calculating heat dissipation capacity. Some values have been filled in using data from FIG. 19, though the others are more situation-dependent.

TABLE 3

Look-up Table

| Altitude (ft) | Ambient temperature (° f.) | Ambient pressure (psia) | Density of air ($lb_m/ft^3$) | Velocity (mph) | Angle of attack (degrees) | Flap conditions |
|---|---|---|---|---|---|---|
| 25000 | −30.15 | 5.454 | 0.03427 | 300 | 5 | Down |
| 30000 | −47.98 | 4.365 | 0.02861 | 500 | 3 | Up |
| 35000 | −65.82 | 3.458 | 0.02370 | 600 | 2 | Up |
| 40000 | −69.70 | 2.720 | 0.01883 | 580 | 0 | Up |

The preferred embodiment of the invention is an airplane, aforementioned as a moving vehicle, which is equipped with a combined cycle power generation system operating as a top with bottom cycle. The system efficiency is optimized, as known in the art, by the bottom cycle being a Rankine cycle. The particularly preferred Rankine cycle utilizes a working fluid that will both not freeze at the low ambient temperatures of a high altitude airplane and is a liquid at reasonably low (relative to earth-bound ambient temperatures) pressures in order to maximize the power 7 generated by the bottom cycle expander 60. Maximizing power 7 generation, as known in the art, is accomplished by operating at a high pressure ratio. The preferred pressure ratio between the expander 60 inlet and outlet is greater than 3:1, the particularly preferred pressure ratio is greater than 4:1, and the specifically preferred pressure ratio is greater than 5:1. As in all Rankine cycles, a condenser 70 is required to remove thermal energy such that a pump 80 is free of cavitation and the working fluid is a liquid, which minimizes the amount of work required to pressurize the working fluid from the low-side pressure to the high-side pressure of the thermodynamic cycle. Typical condensers within a stationary Rankine cycle utilizes either a power-consuming fan to create air flow or a power-consuming pump to create water flow to remove thermal energy, which not only consumer power (thus reducing the net power production) but more importantly creates significant drag on the moving vehicle.

The airplane has a wide range of exterior surfaces in which relative motion between the exterior surface and passing air flow, including wing, tail, and fuselage. It is preferred that the condenser 70 heat exchanger is embedded in an upper, at least relative to the lower, surface of any of the aforementioned exterior surfaces. The particularly preferred exterior surface is in relatively close proximity to the top cycle, such as to minimize the distance in which the internal working fluid of the Rankine cycle must travel. Thermally heating the external fluid decreases the density of the external fluid, which as per Bernoulli's principle will decrease the pressure on the upper surface, which has the benefit of increasing the lift of the moving vehicle. Without being bound by theory, this increase of lift is more beneficial to the moving vehicle as it is not accompanied with as much corresponding drag as otherwise present without the heated external fluid (i.e., air). The direction of lift, as well as drag, is represented by a lift or corresponding drag vector. It is an object of the invention such that any increase in lift from heating of external fluid is in an approximately similar (i.e., positive and not negative) vector such that the total lift is greater than the otherwise achieved lift without thermal heating of the external fluid. The preferred gain in the lift vector is at least 0.5% greater, the more preferred gain in the lift vector is at least 1% greater, and the specifically preferred gain in the lift vector is at least 5% greater.

The impact of the bottom cycle and the increased lift provides a gain in efficiency of at least 0.5% greater than an equivalent moving vehicle without a bottom cycle or heating of external fluid. A more preferred efficiency gain is greater than 1%, with particularly preferred efficiency gain greater than 5%, and specifically preferred efficiency gain greater than 15%. Without being bound by theory, this is accomplished by heating the surface of the upward-facing exterior surface more than a downward-facing exterior surface.

The combined gain in efficiency attributed to the bottom cycle and the gain in lift yields a vehicle efficiency gain of at least 2.0% greater than an equivalent vehicle without thermal heating of the upward-facing exterior surface. Particularly preferred efficiency gains are at least 5.0% greater than the moving vehicle energy efficiency without thermal energy from the thermal energy source, with specifically preferred efficiency gains greater than 15%. The efficiency gain is at least in part due to the top cycle 10 yielding waste heat 15 utilized in the bottom cycle, thus both cycles produce power 7 and thermal energy, though waste heat 15 from the top cycle is utilized as "fuel" to the bottom cycle.

Another embodiment of the invention utilizes an energy storage 9 device as known in the art of hybrid vehicles. The energy storage 9 device is utilized to increase the energy efficiency of the air plane by multiple methods including: (a) enabling the combined top and bottom cycle efficiency to be optimized such that the power 7 produced is greater than required to maintain the velocity and direction of the air plane at the precise moment (as determined by a flight controller/management system), and (b) enabling an electric motor connected to a propelling measure (i.e., propeller, ducted fan, unducted fan, etc.) to recover gravitational and/or momentum energy as the airplane descends from one altitude to a second or slows down from one cruising speed to another, both being analogous to regenerative braking in a hybrid automobile/truck.

A particularly preferred embodiment enables the electric motor connected to a propelling measure to also retract during conditions in which the full rated capacity of the electric motor is not required to maintain the altitude and velocity of the airplane as determined by the flight management system. This is particularly preferred when more than one electric motor is present, such that a first electric motor can operate closer to its optimal efficiency while a second electric motor can retract into a reduced drag configuration. The electric motor can utilize electricity stored in the energy storage 9 device in an asynchronous manner (i.e., charging of energy storage device enables energy use at a subsequent time).

Fuel consumption is optimized by using a controller in conjunction with a flight controller/management system to regulate the thermodynamic cycle parameters including high-side pressure, a low-side pressure, a high-side temperature, and a low-side temperature; the mass flow rate of the internal working fluid, the high-side pressure of the internal working fluid upstream of an expander 60, the low-side pressure of the internal working fluid downstream of the expander 60, the high-side temperature of the internal working fluid, the pressure ratio between the high-side pressure and the low-side pressure, and the heat transfer into the internal working fluid at the high-side pressure, and the heat transfer out of the internal working fluid at the low-side pressure; whereby the internal working fluid dissipates thermal energy through the relative motion of the moving exterior surface to the external fluid. It is understood that the flight management system, as in part operating by commands provided by air traffic control (i.e., traffic controller), specifically prevents direct control of the most important parameter to operating the bottom cycle, which is the velocity of the external fluid that directly impacts the thermal energy removed from the bottom cycle internal working fluid downstream of the expander 60 (and when present recuperator 1, de-icer, etc.).

The lack of direct control of thermal energy out of internal working fluid, and the requirement that the internal working fluid downstream of the condenser 70 to be a liquid, demands the use of a predictive controller. The predictive controller utilizes a flight plan, air traffic commands, or historic data providing detailed simulation data for the airplane to create a safety operating envelope. The safety operating envelope translates into anticipating changes in mass flow and pressure ratio of internal working fluid in order to maintain operating envelope conditions downstream of the condenser 70 as well. Such changes account for vehicle changes in traveling conditions (i.e., preparing for descent, change in cruising altitude and/or velocity). The predictive controller also regulates the retraction of at least one electric motor in order to reduce drag creation. Furthermore, the controller regulates the mass flow and pressure ratio of the thermodynamic cycles by utilizing airplane operating characteristics/parameters including angle of attack, density of external fluid, moving vehicle velocity and velocity vector, and moving vehicle configuration.

Virtually all of the aforementioned embodiments are relevant to a wind turbine system, such that the blades of the wind turbine are effectively equivalent to an airplane's wings, even though the wind turbine system itself is stationary. In this instance, the wind turbine system is stationary, but the turbine blades have movement that is rotational in nature rather than either vertical or horizontal. The turbine blades similarly have a lift and drag vector in similar manner as the wing of the airplane.

The wind turbine preferred embodiment has a relatively stationary first power generation thermodynamic cycle, which is preferably an open cycle Brayton system effectively positioned within the hub of the wind turbine. The second power generation thermodynamic cycle is preferably rotating with wind turbine blades such that the heat exchanger (i.e., evaporator 50) is also rotating, where the heat exchanger is downstream of the waste heat exhaust of the first power cycle.

What is claimed is:

1. A moving vehicle system comprising: a moving vehicle with a first power generation thermodynamic cycle operable to produce power and thermal energy and a second power generation thermodynamic cycle operable to produce power from the first power generation thermodynamic cycle thermal energy; wherein the second power generation thermodynamic cycle is comprised of a working fluid, a working fluid pump or compressor and a condenser operable to remove thermal energy from the working fluid immediately upstream of the working fluid pump, a moving vehicle energy efficiency, and a moving vehicle exterior lift creating surface in thermal communication with the thermal energy from the working fluid operable as the second power generation thermodynamic cycle condenser to dissipate thermal energy from the working fluid wherein the moving vehicle energy efficiency is at least 0.5% greater than the moving vehicle energy efficiency without the thermal energy from the thermal energy second power generation thermodynamic cycle condenser in the moving exterior lift creating surface.

2. The moving vehicle system according to claim 1, wherein the moving vehicle has a lift vector and a drag vector, wherein the moving vehicle exterior surface is operable to dissipate thermal energy from the second power generation thermodynamic cycle working fluid and wherein the lift vector is at least 0.5% greater than the lift vector of the first power generation thermodynamic cycle without thermal energy from the thermal energy source.

3. The moving vehicle system according to claim 1, wherein the moving vehicle has a lift vector and a drag vector, wherein the moving exterior surface is operable to dissipate thermal energy from the first power generation thermodynamic cycle and wherein the lift vector is at least 1.0% greater than the lift vector of the first power generation thermodynamic cycle without thermal energy from from the first power generation thermodynamic cycle.

4. The moving vehicle system according to claim 1, wherein the first power generation thermodynamic cycle is a closed loop thermodynamic cycle and the first power generation thermodynamic cycle is further comprised of a condenser and working fluid and the first power generation thermodynamic cycle condenser is void of at least one condenser fan.

5. The moving vehicle system according to claim 1, whereby the moving vehicle is further comprised of a second power generation thermodynamic cycle operable to produce power and thermal energy, and whereby the second power generation thermodynamic cycle is a closed loop thermodynamic cycle and is a bottom cycle to the first power generation thermodynamic cycle and the second power generation thermodynamic cycle condenser is void of at least one condenser fan.

6. The moving vehicle system according to claim 2, is further comprised of a first moving vehicle exterior surface and a second moving vehicle exterior surface, wherein the first moving vehicle exterior surface is closer to the direction of the lift vector than the second moving vehicle exterior surface, and wherein the first moving vehicle exterior surface is in thermal communication with the working fluid of at least one of the first power generation thermodynamic cycle or the second power generation thermodynamic cycle.

7. The moving vehicle system according to claim 5 wherein the moving vehicle energy efficiency is at least 2.0% greater than the moving vehicle energy efficiency without thermal energy from the working fluid of at least one of the first power generation thermodynamic cycle or the second power generation thermodynamic cycle.

8. The moving vehicle system according to claim 5 wherein the moving vehicle energy efficiency is at least 5.0% greater than the moving vehicle energy efficiency without thermal energy from the working fluid of at least one of the first power generation thermodynamic cycle or the second power generation thermodynamic cycle.

9. The moving vehicle system according to claim 5 whereby the moving vehicle exterior surface in thermal communication with the working fluid of at least one of the first power generation thermodynamic cycle or the second power generation thermodynamic cycle is in thermal communication with a heat-dissipating external moving fluid in thermal communication with the working fluid of at least one of the first power generation thermodynamic cycle or the second power generation thermodynamic cycle and whereby the condenser is void of any energy-consuming mechanism operable to move the heat-dissipating external moving fluid over the moving vehicle exterior surface in thermal communication with the working fluid of at least one of the first power generation thermodynamic cycle or the second power generation thermodynamic cycle.

10. A moving vehicle system comprising: a moving vehicle with a first power generation thermodynamic cycle operable to produce only electrical power and thermal energy; a second power generation thermodynamic cycle having an expander operable to produce only electrical power and thermal energy; a moving vehicle energy efficiency; an electrical energy storage device, the first power generation thermodynamic cycle having a thermal energy source from downstream of the second power generation thermodynamic cycle, and a moving vehicle exterior surface in thermal communication with thermal energy from the second power generation thermodynamic cycle operable to dissipate the thermal energy wherein the moving vehicle energy efficiency is at least 0.5% greater than the moving vehicle energy efficiency without thermal energy into the first power generation thermodynamic cycle from downstream of the second power generation thermodynamic cycle expander.

11. The moving vehicle system according to claim 10, wherein the moving vehicle is further comprised of at least two electric motors wherein the electric motors are powered entirely from the first power generation thermodynamic cycle and the second power generation thermodynamic cycle operable to propel the moving vehicle greater by at least 1% than drag created by the at least two electric motors, wherein at least one of the at least two electric motors is retractable, whereby the controller regulates the retraction of at least one of the at least two electric motors operable to reduce drag created.

12. A method of reducing fuel consumption by a moving vehicle having an angle of attack, a velocity, an ambient temperature, and a laminar flow over a moving vehicle exterior surface in thermal communication with a waste heat from a first power generation thermodynamic cycle having an expander, a compressor, and a pump operable to produce power and waste heat, the method comprising a controller having control parameters of at least the moving vehicle angle of attack and moving vehicle velocity, controlling a moving vehicle having a relative motion to an external fluid and the first power generation thermodynamic cycle; a moving vehicle having an energy efficiency, a moving vehicle exterior surface in thermal communication with the waste heat operable to dissipate thermal energy, and wherein the first power generation thermodynamic cycle is a closed loop thermodynamic cycle having an internal working fluid, a high-side pressure, a low-side pressure, a high-side temperature, and a low-side temperature; whereby the controller regulates the mass flow rate of the internal working fluid as a function of at least the velocity, angle of attack and ambient temperature, the high-side pressure of the internal working fluid upstream of the expander, the low-side pressure of the internal working fluid downstream of the expander, the high-side temperature of the internal working fluid, the pressure ratio between the high-side pressure and the low-side pressure, and the heat transfer into the internal working fluid at the high-side pressure, and the heat transfer out of the internal working fluid at the low-side pressure; whereby the internal working fluid dissipates waste heat through the relative motion of the moving vehicle exterior surface to the external fluid.

13. The method of reducing fuel consumption according to claim 12 wherein the moving vehicle is further comprised of a second power generation thermodynamic cycle generating both power and waste heat, wherein the second power generation thermodynamic cycle is a closed loop cycle, and wherein the first power generation thermodynamic cycle has a recuperator and is a recuperated cycle and wherein the first power generation thermodynamic cycle recuperator obtains thermal energy from the second power generation thermodynamic cycle waste heat.

14. The method of reducing fuel consumption according to claim 12 wherein the controller is further comprised of a predictive controller to anticipate changes in mass flow and pressure ratio of internal working fluid as a result in a calculated change of at least one of the moving vehicle altitude, velocity, and angle of attack operable to achieve conditions downstream of condenser.

15. The method of reducing fuel consumption according to claim 12 wherein the moving vehicle is further comprised of de-icing equipment and wherein the predictive controller includes moving vehicle changes in icing conditions.

16. The method of reducing fuel consumption according to claim 12 wherein the moving vehicle is void of a propulsive measure from both the first power generation thermodynamic cycle and the second power generation thermodynamic cycle and wherein the moving vehicle is further comprised of at least two electric motors operable to propel the moving vehicle, wherein at least one of the at least two electric motors is retractable, and whereby the controller regulates the retraction of at least one of the at least two electric motors operable to reduce drag created.

17. The method of reducing fuel consumption according to claim 12 wherein the controller regulates the mass flow and pressure ratio of the first power generation thermodynamic cycle utilizing additional parameters including density of external fluid, moving vehicle velocity vector, and moving vehicle configuration.

* * * * *